US007158107B2

(12) United States Patent
Kawabe et al.

(10) Patent No.: US 7,158,107 B2
(45) Date of Patent: Jan. 2, 2007

(54) DISPLAY DEVICE FOR DISPLAYING VIDEO DATA

(75) Inventors: Kazuyoshi Kawabe, Fujisawa (JP); Tsutomu Furuhashi, Yokohama (JP); Tatsuhiro Inuzuka, Odawara (JP); Hiroshi Kurihara, Mobara (JP); Kikuo Ono, Mobara (JP)

(73) Assignees: Hitachi, Ltd., Tokyo (JP); Hitachi Video and Information Ststems, Inc., Kanagawa-Ken (JP)

( * ) Notice: Subject to any disclaimer, the term of this patent is extended or adjusted under 35 U.S.C. 154(b) by 904 days.

(21) Appl. No.: 09/805,190

(22) Filed: Mar. 14, 2001

(65) Prior Publication Data

US 2002/0024481 A1 Feb. 28, 2002

(30) Foreign Application Priority Data

Jul. 6, 2000 (JP) ..... 2000-210686
Dec. 8, 2000 (JP) ..... 2000-379778

(51) Int. Cl.
*G09G 3/36* (2006.01)

(52) U.S. Cl. ..... 345/89; 345/94; 345/208

(58) Field of Classification Search ..... 345/87–103, 345/211, 212, 214, 213, 690–692, 694, 204–205, 345/208–210

See application file for complete search history.

(56) References Cited

U.S. PATENT DOCUMENTS 5,347,294 A 9/1994 Usui
5,406,305 A * 4/1995 Shimomura et al. ..... 345/102
5,465,102 A * 11/1995 Usui et al. ..... 345/89
5,495,265 A 2/1996 Hartman et al.
5,699,078 A 12/1997 Yamazaki et al.
5,920,300 A * 7/1999 Yamazaki et al. ..... 345/94
6,219,017 B1 * 4/2001 Shimada et al. ..... 345/88
6,329,980 B1 * 12/2001 Uehara et al. ..... 345/204
6,501,451 B1 * 12/2002 Sakashita ..... 345/87
6,556,180 B1 * 4/2003 Furuhashi et al. ..... 345/87
6,825,824 B1 11/2004 Lee

FOREIGN PATENT DOCUMENTS

| | | |
|---|---|---|
| JP | 3-126070 | 5/1991 |
| JP | 4-288589 | * 10/1992 |
| JP | 4-365094 | 12/1992 |
| JP | 7-56532 | 3/1995 |
| JP | 10-333648 | 12/1998 |
| JP | 2001-265298 | 9/2001 |
| TW | 405728 | 9/2000 |

* cited by examiner

OTHER PUBLICATIONS

Japanese Patent Abstract Patent No. JP10039837.

*Primary Examiner*—Lun-Yi Lao
(74) *Attorney, Agent, or Firm*—Antonelli, Terry, Stout and Kraus, LLP.

(57) ABSTRACT

The present invention includes: a liquid crystal panel 105 on which is formed a matrix of a plurality of image elements; a correction circuit 107 that receives a video data gradation signal input, generates a correction signal for correcting luminance using a relationship defined by the gradation level from an input gradation for an (N−1)-th frame and the gradation level from an input gradation for an N-th frame, and corrects the input gradation signal for the N-th frame using the correction signal; a data driver 109 generating a write potential based on the corrected input gradation signal for the N-th frame and applies the potential to an image element; and a scan driver selecting an image element to which the write potential is applied.

20 Claims, 35 Drawing Sheets

FIG.8

| | | Final gradation level | | | | | | | | |
|---|---|---|---|---|---|---|---|---|---|---|
| | | **0** | **31** | **63** | **95** | **127** | **159** | **191** | **223** | **255** |
| Initial gradation level | **0** | - | 23 | 29 | 27 | 26 | 25 | 23 | 19 | 13 |
| | **63** | 10 | 16 | - | 20 | 20 | 20 | 20 | 17 | 11 |
| | **127** | 10 | 13 | 15 | 17 | - | 18 | 17 | 14 | 10 |
| | **191** | 10 | 13 | 15 | 16 | 16 | 18 | - | 14 | 10 |
| | **255** | 14 | 15 | 18 | 18 | 19 | 18 | 19 | 17 | - |

| Initial gradation level | Approxiation function |
|---|---|
| **0** | $-0.000618\ (I-104)^2 + 27$ |
| **63** | $-0.000580\ (I-132)^2 + 20$ |
| **127** | $-0.000458\ (I-132)^2 + 17$ |
| **191** | $-0.000421\ (I-129)^2 + 17$ |
| **255** | $-0.000258\ (I-142)^2 + 18$ |

| | | Post-modeification gradation level sample (hex) | | | | | | | | |
|---|---|---|---|---|---|---|---|---|---|---|
| | | (1) 00 | (2) 1F | (3) 3F | (4) 5F | (5) 7F | (6) 9F | (7) BF | (8) DF | (9) FF |
| Pre-modification gradation level sample (hex) | (1) 00 | 00 | 60 | 8B | CB | EB | F3 | FF | FF | FF |
| | (2) 1F | 00 | 1F | 6B | AB | DB | E7 | FF | FF | FF |
| | (3) 3F | 00 | 00 | 3F | 8F | C8 | E0 | F0 | FF | FF |
| | (4) 5F | 00 | 00 | 0F | 5F | AC | D3 | EB | FF | FF |
| | (5) 7F | 00 | 00 | 00 | 38 | 7F | C0 | E2 | FF | FF |
| | (6) 9F | 00 | 00 | 00 | 1E | 60 | 9F | D4 | F7 | FF |
| | (7) BF | 00 | 00 | 00 | 11 | 4F | 80 | BF | E0 | FF |
| | (8) DF | 00 | 00 | 00 | 00 | 2C | 5C | 97 | DF | FF |
| | (9) FF | 00 | 00 | 00 | 00 | 13 | 3F | 70 | C3 | FF |

| | | Slope (Hex) | | |
|---|---|---|---|---|
| | | Decrease | Increase | |
| | | | Below node | At or above node |
| Pre-change gradation level sample (Hex) | (1)00 | - | 65/80 | 50/80 |
| | (2)1F | 0F/20 | 55/70 | 40/70 |
| | (3)3F | 3F/40 | 4F/60 | 30/60 |
| | (4)5F | 5F/60 | 35/50 | 30/50 |
| | (5)7F | 7F/80 | 28/40 | 4/40 |
| | (6)9F | 85/A0 | 1A/30 | 1A/30 |
| | (7)BF | 88/C0 | 0F/20 | 0F/20 |
| | (8)DF | AF/E0 | 02/10 | 02/10 |
| | (9)FF | F0/FF | - | - |

| | | Quadratic coefficient (Hex) | |
|---|---|---|---|
| | | Decrease | Increase |
| Pre-change gradation level sample (Hex) | (1)00 | - | 3/200 |
| | (2)1F | 8/200 | 3/200 |
| | (3)3F | 6/200 | 3/200 |
| | (4)5F | 4/200 | 4/200 |
| | (5)7F | 3/200 | 4/200 |
| | (6)9F | 2/200 | 4/200 |
| | (7)BF | 1/200 | 5/200 |
| | (8)DF | 1/200 | A/200 |
| | (9)FF | 1/200 | - |

FIG.43A
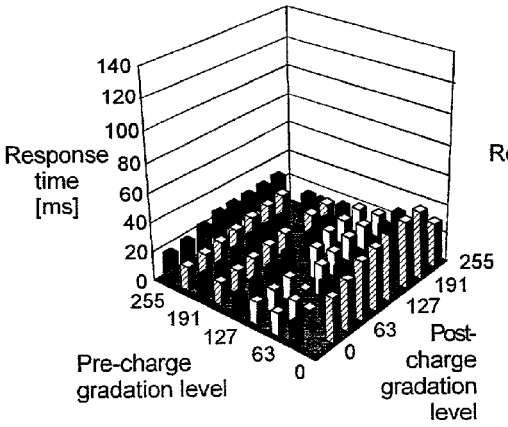
FIG.43B
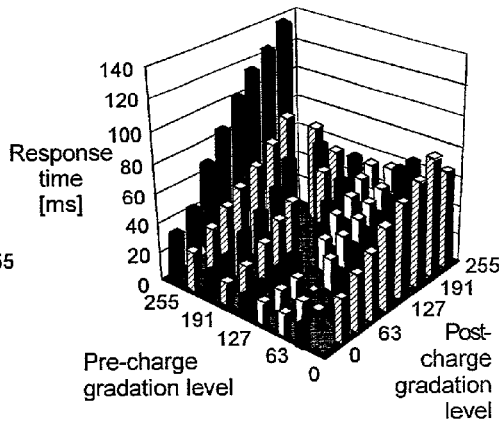
FIG.44
| | | Time constant $\tau$ (ms) | Correction coefficient $\alpha$ | | Filter coefficient $K$ | |
|---|---|---|---|---|---|---|
| | | | Decrease | Increase | Decrease | Increase |
| Charac-teristic | Horizontal electric field | 33.4 | 0.75 | 1.25 | 1.50 | 2.50 |
| | Vertical electric field | 16.3 | 1.00 | 0.75 | 1.00 | 0.75 |

DISPLAY DEVICE FOR DISPLAYING VIDEO DATA

BACKGROUND OF THE INVENTION

The present invention relates to a display device for displaying image data (including video data, static image data, and text data) and a display driver for driving display devices. More specifically, the present invention relates to display devices such as liquid crystal display devices, CRT (Cathode-Ray Tube) display devices, plasma display devices, EL (Electro Luminescence) display device, FE (Field Emission) display devices and the like and display drivers driving these display devices.

Recent years have seen the widespread digitizing of video and increased quality in the video signals themselves. There is a demand for displays that can provide high-quality displaying of static images and video. There are many types of displays that display video signals, with particular interest being placed on liquid crystal displays that are compact, low-power, low-flicker, and the like.

However, displaying video on conventional liquid crystal displays results in afterimages, leading to decreased image quality.

A method for improving image quality for displaying video in liquid crystal displays is presented in Japanese laid-open patent publication number Hei 10-39837. This publication describes a liquid crystal display device that includes: a display panel in which liquid crystal is interposed between an active matrix substrate and an opposing electrodes substrate; a driver circuit for the display panel; frame memory means temporarily storing sequentially received video signals and outputting a video signal from the prior frame; and means for converting video signals receiving the sequentially received video signals and the video signal from the prior frame, looking up a look-up table, and correcting and outputting a liquid crystal driver signal to eliminate gradation offsets based on hysteresis in the display panel.

In this conventional technology, a gradation level higher than the gradation level of the video signal is displayed (hereinafter referred to as overshooting) to eliminate gradation offsets causes by hysteresis in the display panel. However, the display panel itself does not generate gradation offsets due to hysteresis, so there is no need to provide overshooting as shown in FIG. 4 from the conventional technology. Thus, correction cannot be provided for luminance surpluses and deficits caused by response delays in the display panel.

Also, in the conventional technology described above, video signal converting means must access the look-up table for each image element in each frame. As the display screen increases in size or resolution, the information in the look-up table increases and the time required to convert a single frame of video information increases. As a result, the display device will not be able to provide fast response times. For example, to perform 256-level displays, correction values must be determined for 256×255=65280 possibilities. Assuming an 8-bit look-up table, 256×255×8=510 kbits of memory would be required. If a single frame contains 1280×1024=1587.2K pixels, there will be 4761.6K image elements (since each pixel is formed Red, Green, and Blue image elements). In other words, for each frame, the look-up table must be accessed 4761.6K times.

SUMMARY OF THE INVENTION

The object of the present invention is to provide a display device and display driver with improved image quality (particularly for video) by applying appropriate luminance surplus/deficit correction.

The present invention generates a correction signal for correcting luminance based on a relationship defined on the basis of an input gradation signal for an (N−1)-th frame and an input gradation signal for an N-th frame. This correction signal is used to correct the input gradation signal for the N-th frame.

With the present invention, luminance surpluses and deficits are corrected by adding or subtracting the correction signal to the gradation signal. This provides improved image quality (particularly for video). For example, the contrast of an input video signal can be reproduced.

BRIEF DESCRIPTION OF THE DRAWINGS

FIG. 8 is a figure showing a data table of response-time constants related to gradation signal changes.

FIG. 43 is a drawing illustrating the differences in optical response characteristics in liquid crystals with different switching modes in an eleventh embodiment of the present invention.

FIG. 44 is a figure showing specific examples of filter coefficients in an eleventh embodiment of the present invention.

DETAILED DESCRIPTION OF THE PREFERRED EMBODIMENTS OF THE INVENTION

The following is a description of the embodiments of the present invention.

(First Embodiment)

Figure 1:
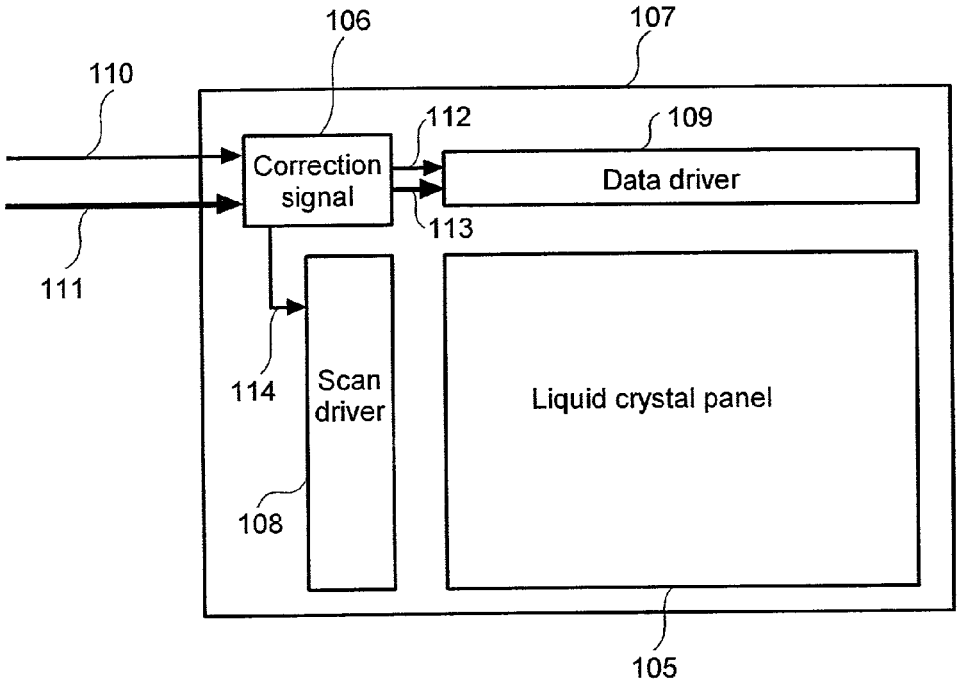
FIG. 1 is a drawing of a system architecture of a liquid crystal display device according to a first embodiment of the present invention.
Figure 2:
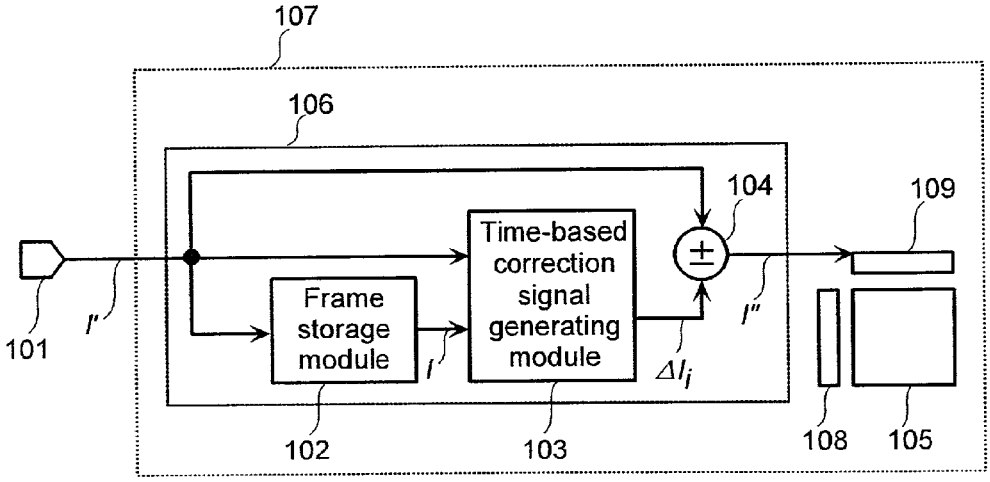
FIG. 2 is a block diagram of a correction circuit according to a first embodiment of the present invention.

FIG. 1 shows a drawing of the system architecture of a first embodiment of the present invention. FIG. 2 shows a block diagram of a correction circuit in the first embodiment of the present invention.

In FIG. 1 and FIG. 2, an input module 101 receives a video signal input. From the video signal, a frame storage module 102 stores a gradation signal corresponding to a single frame. A time-based correction signal generating module 103 generates a correction signal used to compensate for too much or too little luminance. An adder/subtracter 104 performs addition and subtraction on the video signal and the correction signal. A liquid crystal panel 105 displays gradations based on the video signal. A correction circuit 106 generates a correction signal corresponding to the video signal. The figures also show: a liquid crystal module 107; a scan driver 108 sequentially scans row electrodes based on a row clock; a data driver 109 receives one column's worth of column data and then sends drive potential all at once to column electrodes for the column data; a gradation signal 111; and a sync signal 110.

The liquid crystal module 107 is an information processing device that reads display data (video signal) from media and outputs this as a gradation signal. The liquid crystal module 107 is connected to an external device, e.g., a personal computer, a DVD player, a TV, or a VCR, and primarily displays video, including static images. The liquid crystal module 107 is connected to the external device through an interface that transfers signals such as the gradation signal 111 for Red (hereinafter referred to as R), Green (hereinafter referred to as G), and Blue (hereinafter referred to as B) image elements and the sync signal 110 containing a frame clock, a row clock, and an image element clock. The liquid crystal module 107 includes: the correction circuit 106; the scan driver 108, which sequentially scans the row electrodes based on a row clock; a data driver 109, which sequentially receives a gradation signal based on a row clock, reads one row of row data, and then applies a drive potential to row electrodes for the row data; and a liquid crystal panel 105, which forms a matrix of image elements from row electrodes and column electrodes, where individual pixels are formed from R, G, and B image elements arranged adjacent to each other along a row. The correction circuit 106 includes: the frame storage module 102 storing the gradation signal for at least one frame from the display data sent from the input module 101; and the time-based correction signal generating module 103 receiving the gradation data for the previous frame and the current gradation data and compensating for too much or too little luminance based on signal changes between the frames. Of course, in the time-based correction signal generating module 103, the comparison between the gradation signal from the previous frame stored in the frame storage module and the gradation signal for the current frame received from the input module 101 are compared by comparing input signals corresponding to associated image elements. This is then used to generate the correction signal.

In FIG. 2, the gradation signal received from the input module 101 includes R, G, and B inputs. Only one input is shown, however, since the same operations are performed on each of these inputs.

If the connected external device is a personal computer, the input module 101 receives the gradation signal as a digital signal, allowing the input gradation signal to be processed as an input gradation signal by the correction circuit 106 of the display module 107. If, on the other hand, the external device is a DVD, TV, or VCR, the image signal and the sync signal are combined and sent together as an analog signal, so an A/D converter must be placed between the external device and the display device to separate the two signals and perform A/D conversion before the signals are sent to the liquid crystal module 107. The A/D converter can be installed in the external device or in the liquid crystal module 107. The A/D converter is not shown in the figure. The gradation signal from the external device is received and the frame storage module 102 stores at least one frame's worth of the gradation signal. A gradation signal l stored by the frame storage module 102 is delayed by at least one frame interval and is then sent to the time-based correction signal generating module 103 together with a gradation signal l' for the subsequent frame.

Figure 4:
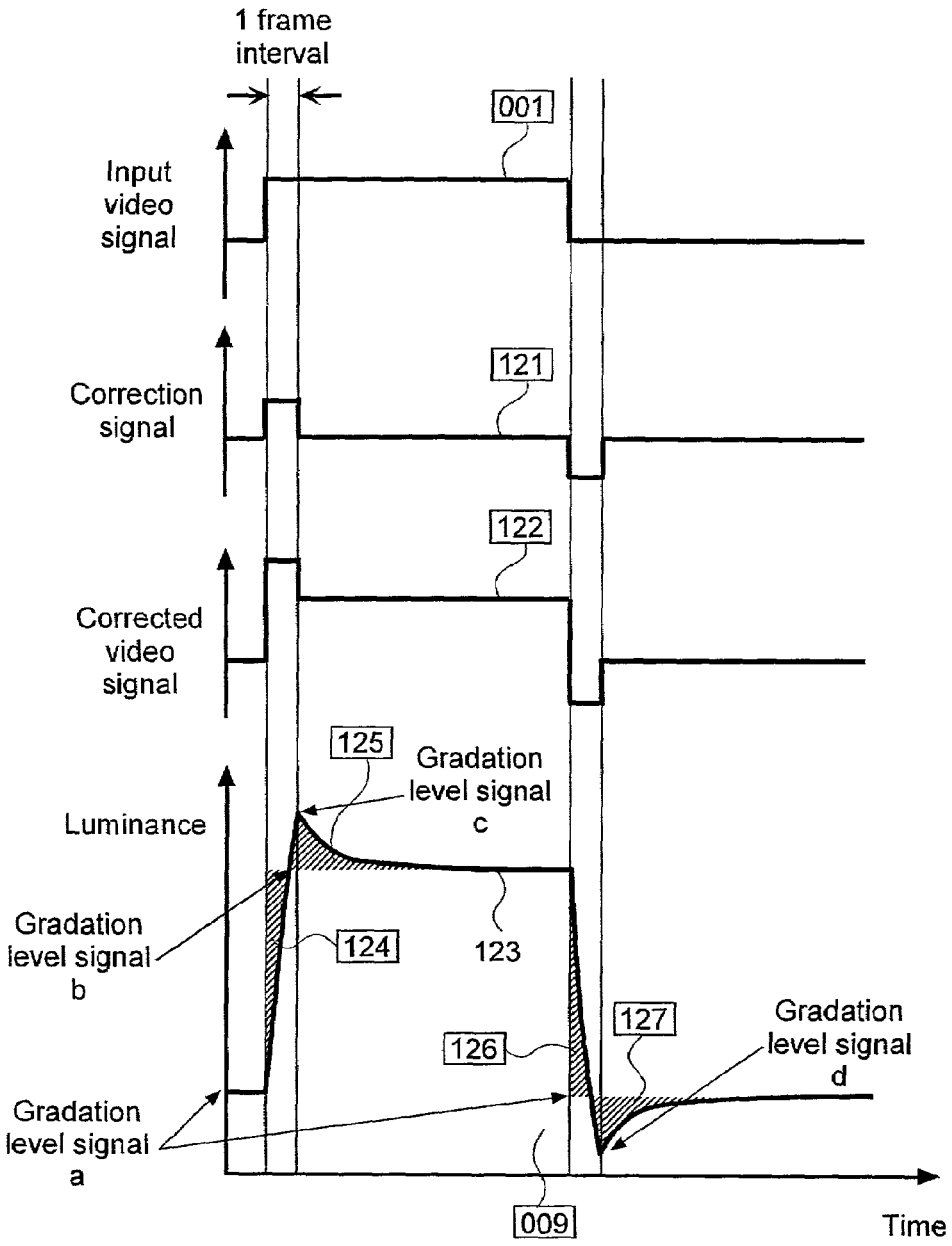
FIG. 4 is a luminance-response curve diagram representing the effect of correction in the present invention.

This time-based correction signal generating module 103 uses the gradation signals l', l to generate a correction signal Δli to provide appropriate corrections for too much or too little luminance due to signal variations. This correction signal Δli is used to compensate for inadequate luminance caused by response delays in the liquid crystal panel 105 and residual luminance (surplus luminance) caused by response delays in the liquid crystal panel 105. As shown in FIG. 4, for an inadequate luminance 124, the correction signal Δli is generated so that a target luminance c is achieved, thus displaying a luminance higher than that of a luminance b of the input gradation signal (this operation will be referred to below as overshooting). Also, in order to compensate for a residual luminance (surplus luminance) 126 in FIG. 4, the compensation signal Δli is generated to provide a target luminance d, thus displaying a luminance that is lower than that of a luminance a of the input gradation signal (this operation will be referred to below as undershooting). In this manner, the time-based correction signal generating module 103 generates the correction signal Δli to cancel the integral of the inadequate luminance 124 by providing an overshooting luminance correction 125, and to cancel the integral of the integral of the residual luminance 126, i.e., the surplus luminance, by providing an undershooting luminance correction 127. The adder/subtracter 104 adds or subtracts this correction signal Δli to the input gradation signal l', and outputs a corrected gradation signal l" to the data driver 109.

As a result, the original contrast of the input gradation signal can be reproduced. In particular, this allows visually sharp images to be displayed from the original gradation signal when displaying video.

The following is a description of how the correction signal Δli is determined, with references to FIG. 3 through FIG. 11.

Figure 3A:
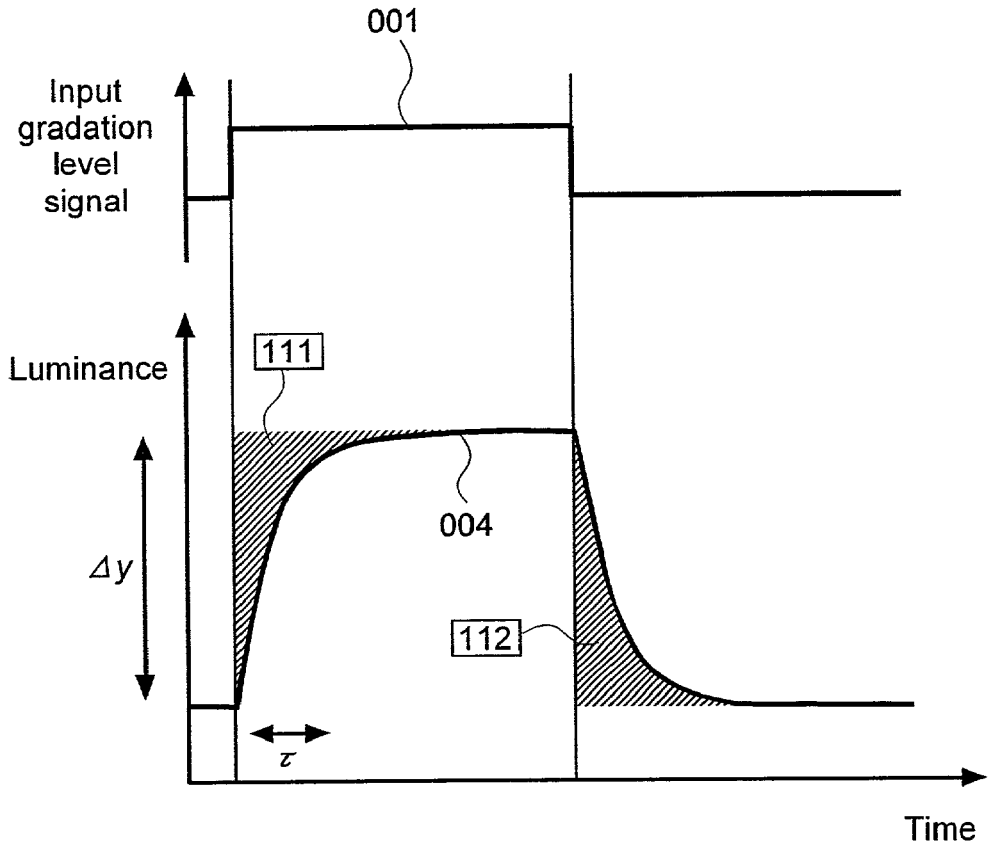
FIG. 3 is a drawing showing luminance surplus/deficit to be corrected by the present invention.

FIG. 3A shows the surplus and deficit luminances to be corrected appropriately by the time-based correction signal generating module 103. As in FIG. 1 [?], a waveform 004 indicates a standard luminance time-response waveform generated by an input gradation signal 001. The figure shows a luminance deficit 111 at the rising response of the curve and a luminance surplus 112 at the descending response of the curve.

Figure 3B:
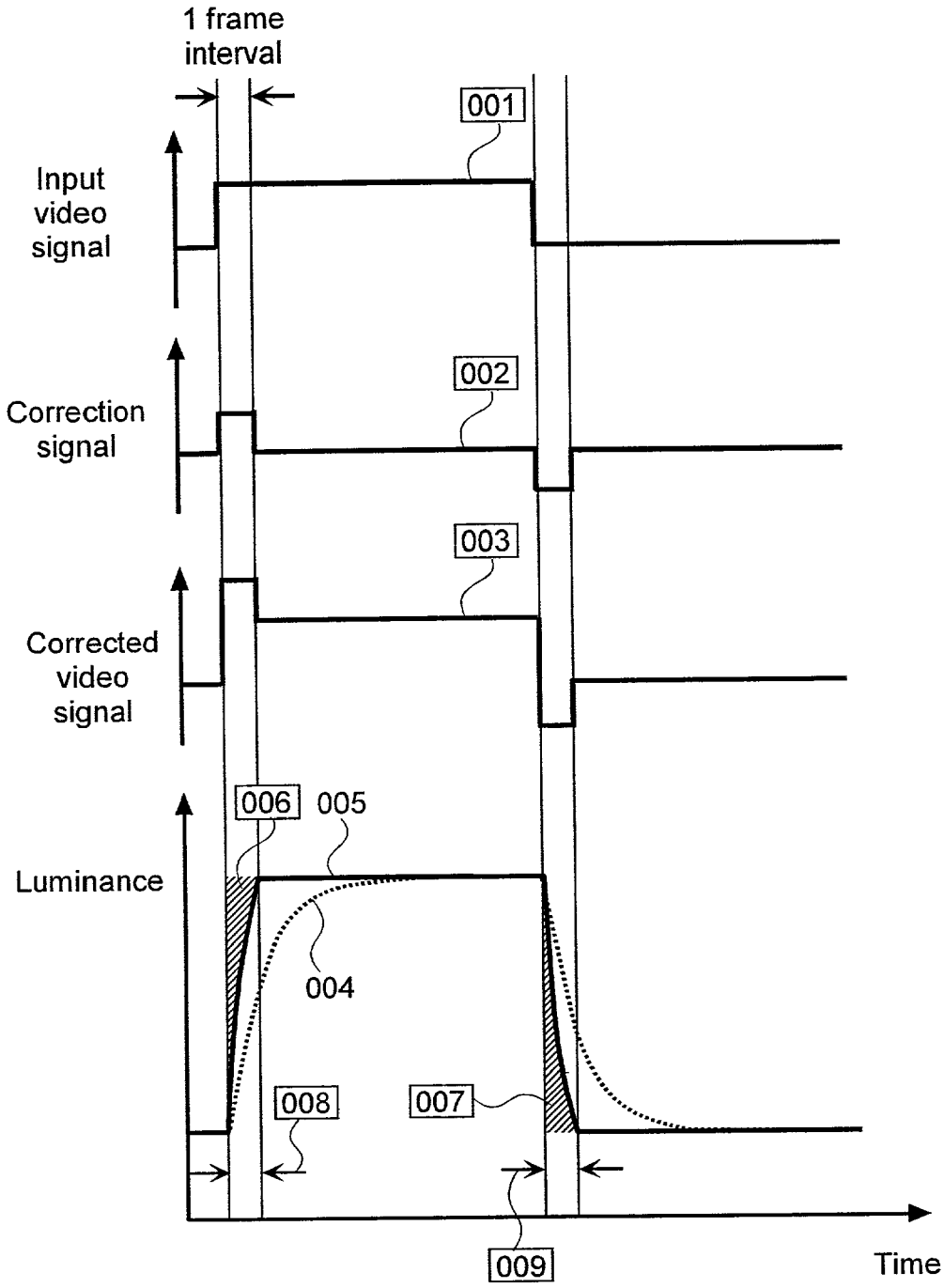

FIG. 3B shows the input gradation signal 001 and the correction signal 002 applied to the signal 001 in order to enhance the changes in the input gradation signal 001 during, for example, a one-frame interval. A signal 003 is the product of adding the correction signal 002 to the input gradation signal 001 and serves as the corrected gradation signal that is sent to the liquid crystal display module, which is formed as a matrix. A curve 004 indicates the standard luminance time response for the gradation signal 001 when no correction is applied. A signal 005 indicates the luminance time response corresponding to the gradation signal 003 when correction is applied. A luminance time-response curve 005, to which correction is applied, shows improved response speed compared to the standard response curve 004.

However, with this driver method, the response speed may be improved but the integral under the luminance curve will show a deficit 006 in a single frame with a rising signal and a surplus 007 in a single frame with a descending signal. Thus, the average luminance will drop during the frames where the gradation signal rises and will increase in the frames where the gradation signal drops.

Thus, in frames with a changing image, luminance surpluses and deficits will generate an intermediate luminance that reduces the contrast of the original video signal. This phenomenon will not take place with images that show almost no signal changes such as in static images. However, in images with many luminance changes such as video, these luminance surpluses and deficits will occur frequently and across a large number of image elements. Thus, in video, the frequent occurrence of intermediate luminance will reduce contrast and significantly degrade image quality. This effect will be most significant when there is a high degree of motion, fast changes in images, and when the video is displayed over a large area.

To overcome this, luminance surpluses and deficits are corrected in the following manner.

In a luminance deficit I, the luminance response curve generally follows an exponential function expressed in terms of a luminance change Δy and a time constant τ (the time constant can be defined, for example, as the time needed for the display panel to display 60% of the luminance corresponding to an input gradation signal). Thus, the luminance response can be analytically determined as follow by using integration.

[Expression 1]

$$I = \int_0^T \exp\left(-\frac{t}{\tau}\right)dt = \Delta y\tau\left(1 - \exp\left(-\frac{T}{\tau}\right)\right)$$

If the image changes in the actual video are not very fast, i.e., if T>>τ, then exp (−T/τ) can be ignored, and approximation can be performed.

Thus, Expression 1 can be expressed as expression 2.

[Expression 2]

$$I = \begin{cases} \Delta y\tau & \text{if } T \gg \tau \\ \Delta y\tau\left(1 - \exp\left(-\frac{T}{\tau}\right)\right) & \text{else} \end{cases}$$

In this and subsequent embodiments, the descriptions will assume that T>>τ for the following reason. Even if the video changes rapidly, multiple frames (3–10 frames, where one frame interval is 16.7 ms) will generally involve sending identical gradation signals. Since, as described in more detail with reference to FIG. 7 and the like, the time constant τ is roughly the same as one frame interval, the assumption described above is applicable. Another reason this assumption is valid is that the human eye has difficulty perceiving gradation changes taking place across three frames or less.

FIG. 4 shows the effects of correction when correction is performed for a one-frame interval in order to quickly compensate luminance surpluses and deficits from expression 2.

Where the frame period is tf, the luminance (c–b) Δyi needed for correction can be determined from expression 2 as shown below.

[Expression 3]

$$\Delta y_i = \frac{I}{t_f} = \frac{\Delta y}{t_f}$$

A correction signal 121 is used to generate the luminance Δyi needed for correction as determined by expression 3. A corrected gradation signal 122 is generated by combining the correction signal 121 with the input gradation signal 001. The curve 123 is the time-response curve of the luminance from the corrected gradation signal 122. For a rising response, the correction signal 121 provides overshooting so that the deficit 124 is compensated by a surplus 125. For a dropping response, undershooting is performed so that the deficit 126 is compensated with a surplus 127. This allows the average luminance to reach the target luminance in a short time.

Figure 5:
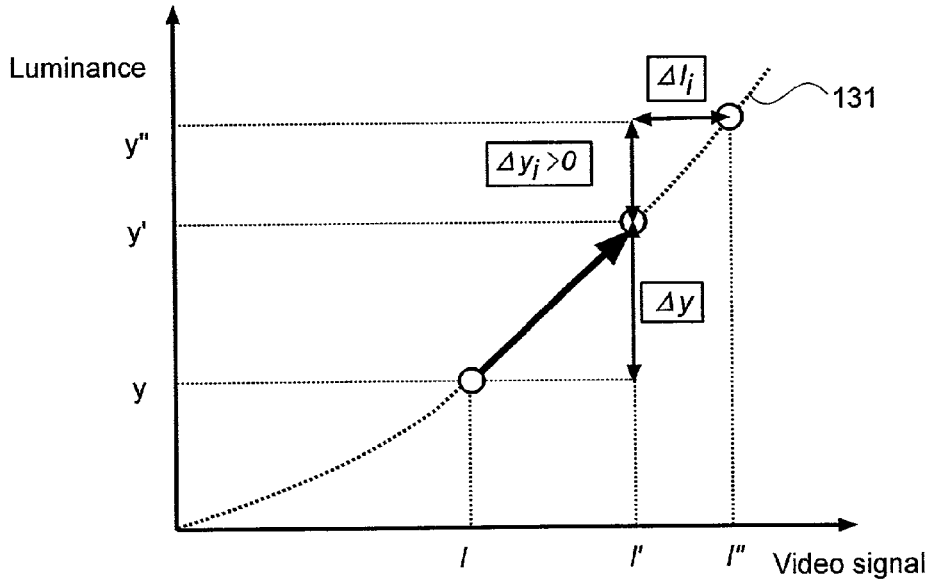
FIG. 5 is a figure illustrating the process by which a correction is derived from the relation between a gradation signal and luminance when a gradation signal increases.
Figure 6:
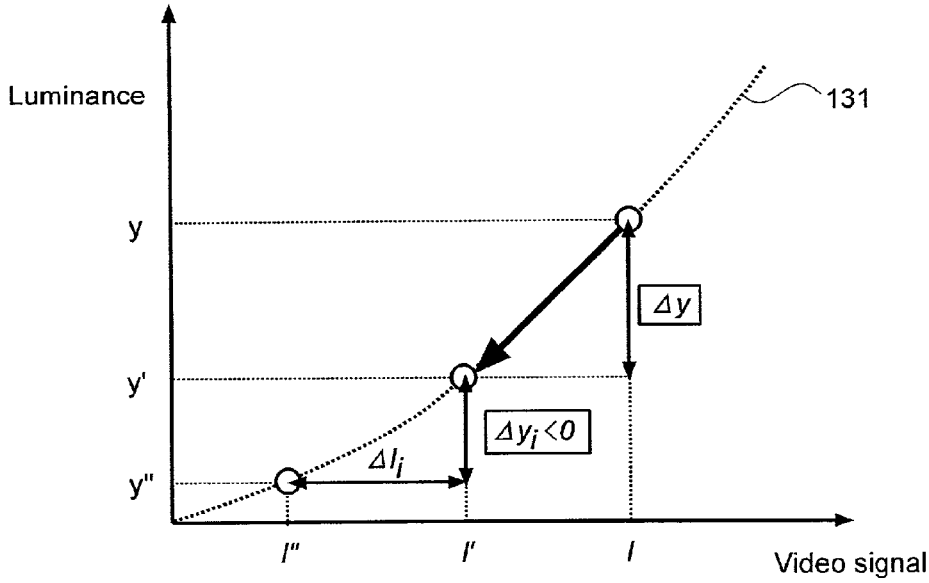
FIG. 6 is a figure illustrating the process by which a correction is derived from the relation between a gradation signal and luminance when a gradation signal decreases.

Next, the method for determining the correction signal will be described in further detail, with references to FIG. 5 and FIG. 6. In FIG. 5 and FIG. 6, a curve 131 indicates the relationship between the gradation signal and luminance. FIG. 5 shows a rising change from the gradation signal l to the gradation signal l'. FIG. 6 shows the dropping change. Where luminance is y and the gradation signal is l, the curve 131 can generally be expressed as shown in expression 4.

$$y = f(l) \qquad \text{[Expression 4]}$$

Thus, as the signal changes from the gradation signal l to the gradation signal l', the luminance change Δy can be determined using expression 4.

Using this luminance change Δy and expression 3, the luminance yi needed for correction can be calculated. The calculated correction luminance Δyi can then be combined with a target luminance y' so that a luminance (y" in FIG. 5) greater than the target luminance y' can be generated for rising change and a luminance (y" in FIG. 6) lower than the target luminance y' can be generated for descending change.

With the inverse function f−1(y) of the curve 131, the composite luminance y'+Δyi can be used to determine the gradation signal l" corrected from the gradation signal l'. Thus, the gradation signal Δli can be represented by expression 5, where the target gradation signal l' is subtracted from the corrected gradation signal l".

[Expression 5]

$$\Delta l_i = f^{-1}\left(f(l') + \frac{\tau}{t_f}(f(l') - f(l))\right) - l'$$

Generally, the function f(l) relating gradation and luminance is represented as shown in expression 6, where γ is a gamma constant and k is a proportionality factor.

$$f(l) = kl^{\gamma} \qquad \text{[Expression 6]}$$

Thus, by using expression 5 and expression 6, the correction signal Δli can be determined as shown in expression 7. However, the gradation signal that can be sent to the data driver 109 in FIG. 2(*b*) must be, for example, within the range of 0–255 for 8-bit signals. Thus, the correction signal Δli to be sent to the liquid crystal panel is clipped so that 255 is used if the value of the gradation signal exceeds 255 and 0 is used if the value is under 0.

[Expression 7]

$$\Delta l_i = \begin{cases} -l' & \text{if } l'^{\gamma} + \frac{\gamma}{t_f}(l'^{\tau} - l') < 0 \\ 255 - l' & \text{else if } \left(l'^{\gamma} + \frac{\gamma}{t_f}(l'^{\gamma} - l')\right)^{\frac{1}{\gamma}} > 255 \\ \left(l'^{\gamma} + \frac{\gamma}{t_f}(l'^{\gamma} - l')\right)^{\frac{1}{\gamma}} - l' & \text{else} \end{cases}$$

Figure 7:
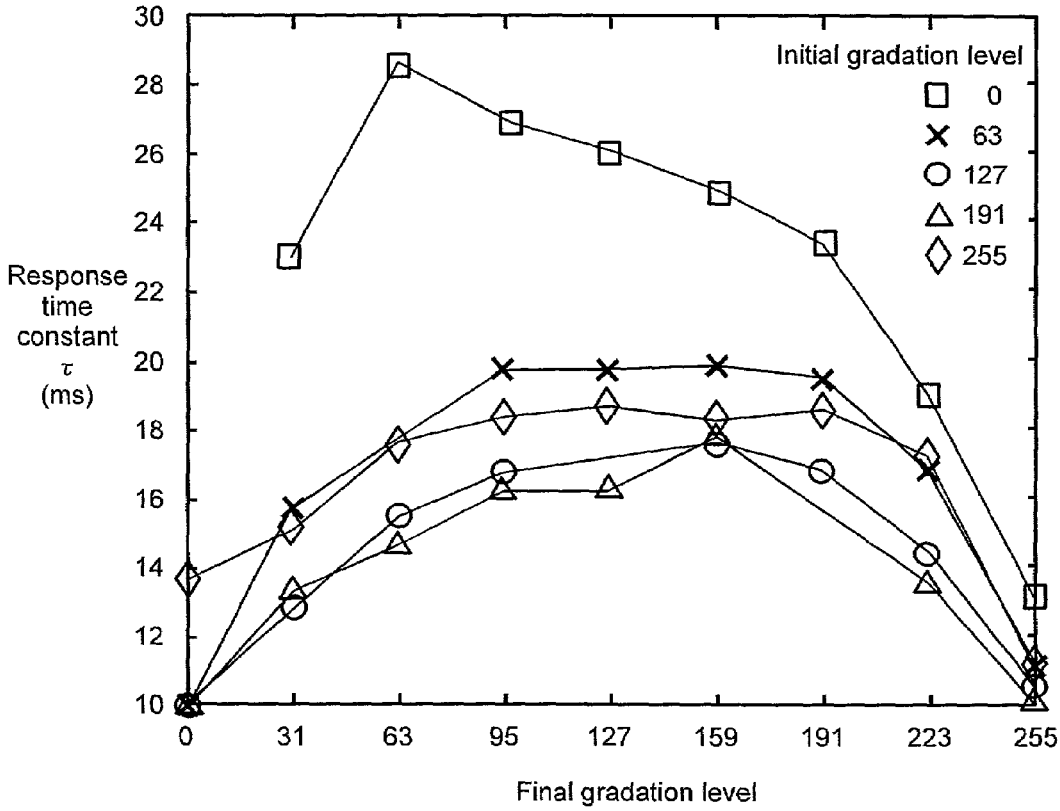
FIG. 7 is a figure showing the relation between gradation signal change and response-time constants.

Next, the dependence of gradation on the response-time constant τ as used in expression 7 will be described with reference to FIG. 7. In FIG. 7, the gradation signal is varied across representative gray scale values and response measurements for these are shown.

According to FIG. 7, response times are slow for changes to intermediate luminance tones, while response times are fast for low and high luminance tones. More specifically, the average value for the response-time constant τ is approximately 16.3 ms, while the maximum value is approximately 28.6 ms and the minimum value is approximately 10.0 ms.

Figures 9A, 9B:
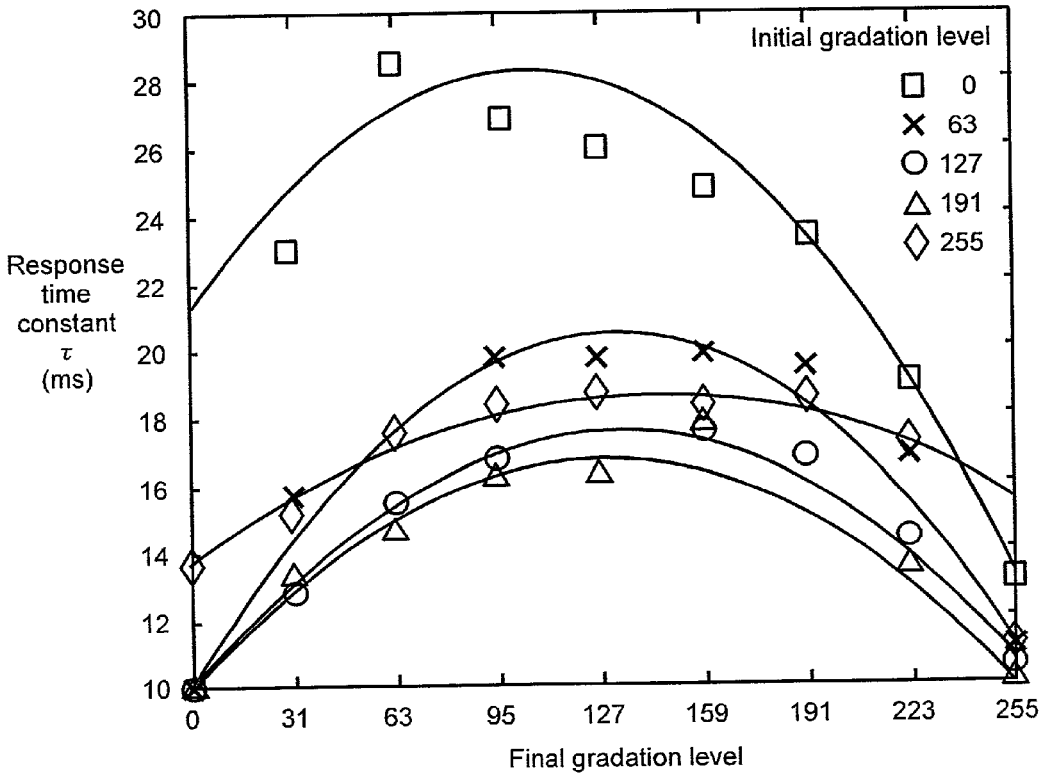
FIG. 9 is a figure illustrating an approximation function representing the relation between gradation signal change and response-time constants.

Thus, the response-time constant τ is dependent on the gradation and can vary by a factor of 0.61–1.75 relative to an average value of 16.3 ms. When calculating the correction signal Δli using expression 7, the response-time constant τ for different gradation signal changes can be stored in a table as shown in FIG. 8 to be looked up. Alternatively, as shown in FIG. 9, this can be simplified using approximation functions involving lines and curves. FIG. 9A shows curves used to approximate the relation between the response-time constant τ and the final gradation l. FIG. 9B shows linear approximation used to determine the relation between the response-time constant τ and the final gradation 1.

Taking into account the fact that the γ value used in standard liquid crystal displays is generally in the range of 1.8–2.2, the value of l'^γ−l^γ in expression 7 a very large value compared to the changes in the response-time constant τ. Thus, in this embodiment, the influence of the response-time constant τ on the gradation is ignored, and the average value of 16.3 ms is used as a constant. This is roughly the same as the 16.7 ms interval for a single frame.

In this embodiment, the luminance response-time constant is for grayscale gradation signal changes. However, different constants can be used in the response-time constant τ for R, G, and B since the back-light persistence characteristic is best for B, and then R and then G. Alternatively, the gradation dependencies shown in FIG. 8 and FIG. 9 can be used for R, G, and B independently.

Figure 10:
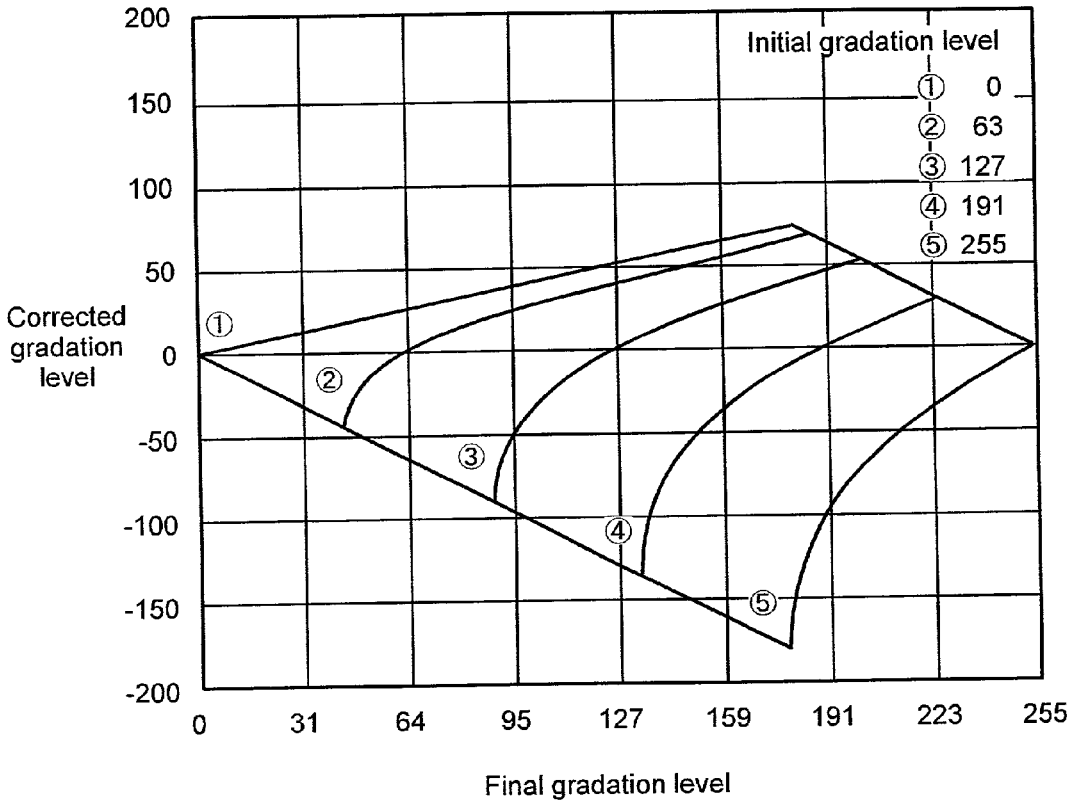
FIG. 10 is a figure illustrating the correspondence between gradation signal changes and correction signals in a first embodiment of the present invention.

FIG. 10 shows the correction signal Δli for different gradation signal changes when the γ value is 2.0, i.e., when the relationship between the gradation signal and luminance is represented by a quadratic expression. Specifically, γ=2.0 is substituted into expression 7, to result in expression 8.

[Expression 8]

$$\Delta l_i = \begin{cases} -l' & \text{if} \quad l'^2 + \frac{\tau}{t_f}(l'^2 - l^2) < 0 \\ 255 - l' & \text{else if} \quad \sqrt{l'^2 + \frac{\tau}{t_f}(l'^2 - l^2)} > 255 \\ \sqrt{l'^2 + \frac{\tau}{t_f}(l'^2 - l^2)} - l' & \text{else} \end{cases}$$

First, changes from a gradation of 127 will be considered (FIG. 10–3). If there is no change in gradation, the correction signal must be 0. If the gradation rises to 159, the correction signal must be 25. If the signal descends to 95, the correction signal must be −50.

If the gradation rises to 223, the combining of the final gradation level and the correction signal will exceed the maximum value of 255, so the correction signal will be reduced to 32. If the gradation drops to 31, the result will be lower than the minimum value of 0 so a similar operation is performed, resulting in a correction signal of about −31.

The reason the correction signal characteristics are different for when the gradation signal rises and falls is that the γ value is 2.0. This is because, as shown in the curve 131 in FIG. 5 and FIG. 6, the higher the gradation signal rises, the greater the luminance change corresponding to a change in gradation is.

As shown in FIG. 5 and FIG. 6, even if correction is to be performed with the same correction luminance |Δyil, rising change can be corrected with a smaller correction signal since the rate of luminance change for rising change is higher (Δli in FIG. 5). Conversely, descending change requires a greater correction signal since the rate of luminance change for descending change is lower (Δli in FIG. 6).

Thus, in FIG. 10, the correction signal is lower for rising change and higher for descending change. This balances out the unevenness in luminance generation resulting from the gamma value.

Figure 11:
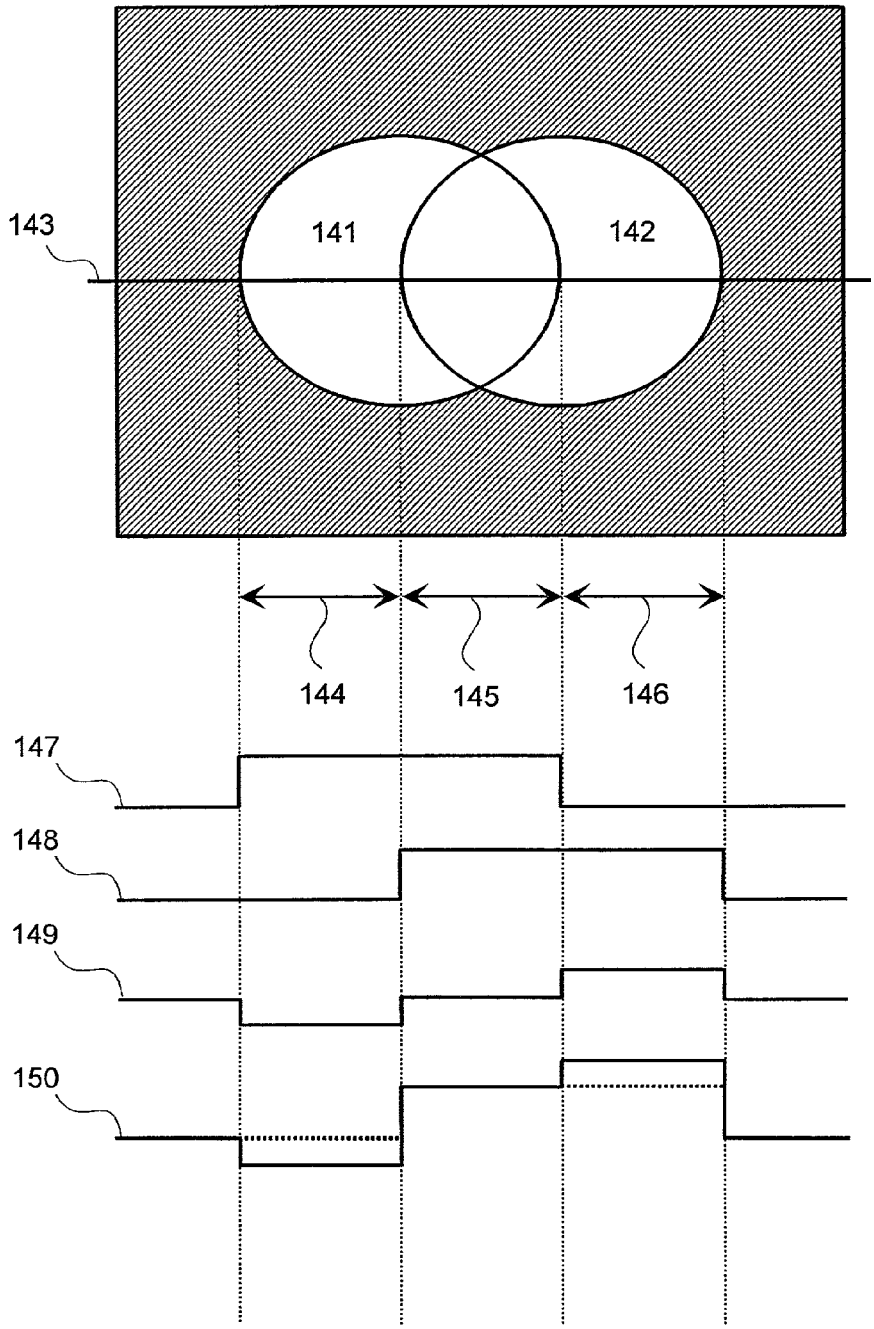
FIG. 11 is a drawing illustrating the spatial effect of correction performed in a first embodiment of the present invention.

Next, the spatial operations performed in this embodiment will be described with reference to FIG. 11. FIG. 11 shows the spatial distribution of a gradation signal when an image 141, where a bright ellipse is located to the left over a dark background, changes to an image 142, where the ellipse moves to the right.

The image change can be divided into three regions: a region 144 that becomes darker; a region 145 that remains unchanged; and a region 146 that becomes brighter.

In FIG. 11, a signal 147 and a signal 148 are the spatial distribution of the gradation signal along an i-th scan line 143 of the original image 141, and the changed image 142, respectively. A correction signal 149 provides compensation for luminance surpluses and deficits that accompany the image change. Since the region 144 changes from a bright image to a dark image, there will be residual brightness. On the other hand, the region 146 changes from a dark image to a bright image, so there will be insufficient brightness. Thus, the correction signal in the correction signal 149 will be generated to remove the surplus luminance in the region 144 and to compensate for the luminance deficit in the region 146. This correction signal 149 is combined with the changed video signal 148 to form a signal 150, which is then sent to the data driver 109 from FIG. 2.

In the correction method of the present invention, correction is not applied to the region 145, where the image remains unchanged. Since this correction is only applied to regions where the video signal changes, static images can be displayed with a high image quality as before. For example, correction can be applied efficiently to video only if video and static images co-exist, as in cases where video is displayed in a window. Thus, this technology can be used as a general-purpose technology that is applicable to monitors for standard notebook PCs and desktop PCs.

(Second Embodiment)

Next, an embodiment that allows the circuit structure to be simplified compared to the first embodiment will be described.

The function f(l) in expression 4, which relates gradation and luminance, is generally a complicated non-linear function. The first embodiment assumed a current type of liquid crystal display, and f(l) was set up as a quadratic expression as shown in Expression 8 with γ=2.0. The correction signal was derived from the inverse function. Actually performing these calculations directly using circuitry or using an inverse function data table or the like can significantly increase the scale of the circuitry.

The second embodiment takes the implementation of the circuitry into account and simplifies the method used to derive the correction signal.

Standard TV images and natural images contain more intermediate tones than primary colors. Thus, there is no need to carefully calculate correction data for all gradation changes as in the first embodiment. Instead, operations can be simplified to provide more efficiency for intermediate tones. Average luminance values are calculated by experimentally determining luminance responses to correction signals and integrating these over an interval of approximately three frames (45 ms). The normalized deviations between these and target luminance values are calculated (by dividing the difference between the target luminance value and the average luminance value and then dividing by luminance change Δy). It was found that for gradation changes in intermediate tones, video quality improved when the normalized deviation was in the range of −30% and 10%. Thus, the correction signal can be calculated in a more simple manner compared to the first embodiment.

In the second embodiment, the correction signal is calculated by using γ=1.0 and simplifying expression 7. When γ=1.0 is substituted into expression 7, the correction signal Δli is as shown in expression 9.

[Expression 9]

$$\Delta l_i = \begin{cases} -l' & \text{if} \quad l' + \frac{\tau}{t_f}(l' - l) < 0 \\ 255 - l' & \text{else if} \quad l' + \frac{\tau}{t_f}(l' - l) > 255 \\ \frac{\tau}{t_f}(l' - l) & \text{else} \end{cases}$$

Thus, the most significant characteristic of this embodiment is that the correction signal Δli can be derived using simple proportionality operations as shown in expression 9. Thus, compared to expression 8, expression 9 provides significantly simplified arithmetic, allowing the circuitry to be easily implemented.

Figure 12:
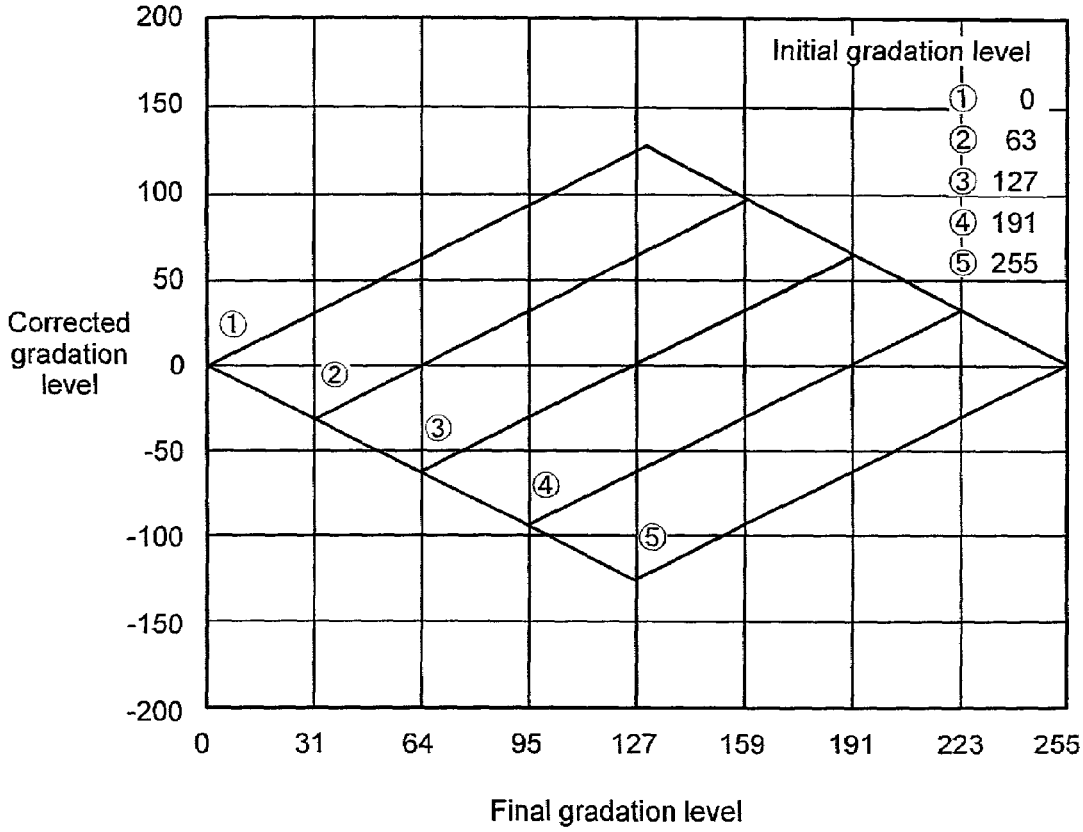
FIG. 12 is a figure illustrating the correspondence between gradation signal changes and correction signals in a second embodiment of the present invention.

FIG. 12 shows the correction signals for different gradation changes as calculated using expression 9.

In the first embodiment, the correction signal is generated in different ways depending on whether the gradation signal is rising or falling. In this embodiment, the relation between gradation and luminance is linear, so rising and falling changes are treated symmetrically.

(Third Embodiment)

Figure 13:
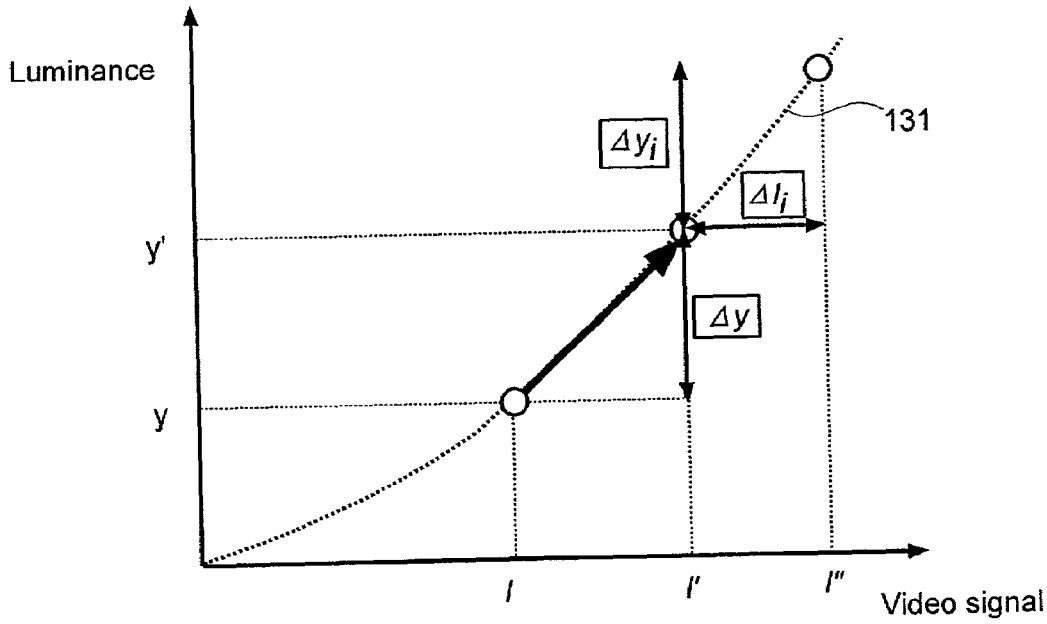
FIG. 13 is a figure illustrating correction error generated during increasing change in a gradation signal in a second embodiment of the present invention.
Figure 14:
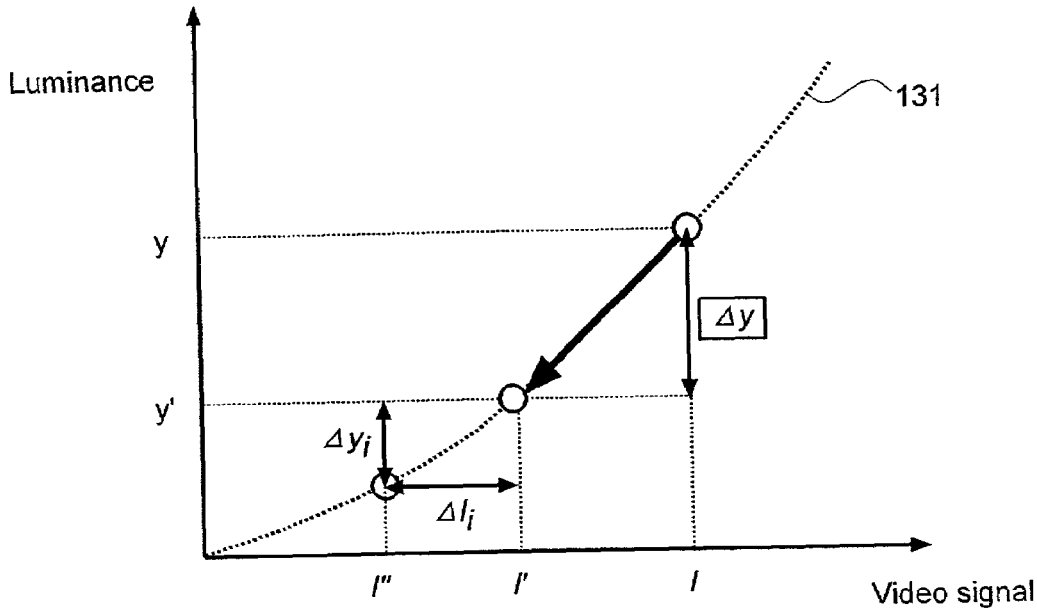
FIG. 14 is a figure illustrating correction error generated during decreasing change in a gradation signal in a second embodiment of the present invention.

The advantage of the method for calculating correction signals in the second embodiment is that the scale of the circuitry can be kept small, thus allowing the correction circuit to be implemented easily. However, when correction signals calculated in this manner are used for the liquid crystal module 107 having a gamma value of 1.8–2.0, the correction error due to the use of linear correction is greater and can degrade image quality. FIG. 13 and FIG. 14 illustrate how large correction errors can be generated.

FIG. 13 shows a rising change from the gradation signal l to the gradation signal l', and FIG. 14 shows a descending change.

In the second embodiment, expression 9 generates the same correction signal Δli if the change in l'−l is the same, regardless of whether the change is rising or descending.

However, if the γ value is 1.8–2.2, as shown in FIG. 13 and FIG. 14, transitions to higher gradations results in greater luminance change. Thus, changes to higher gradations involve excessive correction (Δyi in FIG. 13). Conversely, changes to lower gradations involve inadequate correction (Δyi in FIG. 14).

The third embodiment modifies expression 9 to take γ values into account in order to reduce this type of unbalanced correction resulting from linear calculations. This allows circuit structure to be simple while improving correction.

Figure 15:
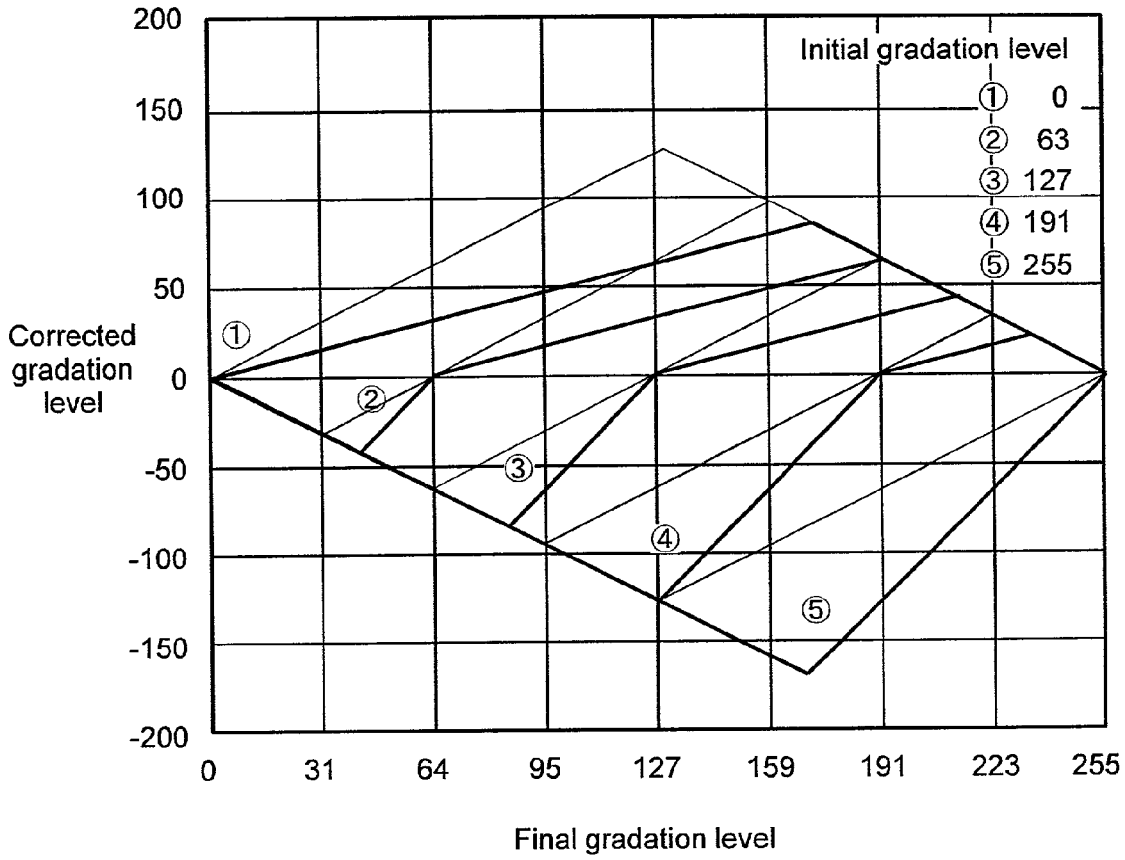
FIG. 15 is a figure illustrating the correspondence between correction signals and gradation signal changes in a third embodiment of the present invention.

FIG. 15 shows the relationship between gradation changes and correction signals. In contrast to the correction signal characteristics from FIG. 12, the correction signal is weighted differently depending on whether there is a rising change or a descending change in the gradation signal.

When linear calculations are used, the correction signals are symmetrical for rising and falling changes. In this embodiment, correction is balanced to take into account the fact that the luminance change rate increases for changes to higher gradations. This is done by providing weaker correction for rising changes and stronger correction for descending changes.

The correction signal is shown in expression 10, where an evaluation is made as to whether the change is rising or falling and, based on this, correction weighting constants alpha r, alpha f are multiplied into expression 9.

[Expression 10]

$$\Delta l_i = \begin{cases} -l' & \text{if} \quad l' < l \text{ and } l' + \frac{\alpha_f \tau}{t_f}(l' - l) < 0 \\ \frac{\alpha_f \tau}{t_f}(l' - l) & \text{else if} \quad l' < l \\ 255 - l' & \text{else if} \quad l' \geq l \text{ and } l' + \frac{\alpha_f \tau}{t_f}(l' - l) > 255 \\ \frac{\alpha_f \tau}{t_f}(l' - l) & \text{else if} \quad l' \geq l \end{cases}$$

The weighting constants alpha r and alpha f can, for example, be stored in a look-up table. Alternatively, a simplified gradation change function can be used. In this embodiment, constants are used to derive the correction signal to keep the circuit scale small.

In this manner, linear calculations are performed to provide a simplified correction signal with expression 9. Using expression 9 as an elementary solution, γ characteristics are considered and weighting is used depending on the polarity of the gradation change, i.e., whether the change is rising or falling. Thus, the scale of the circuitry is significantly reduced compared to the use of expression 8, in which the correction signal is derived directly from γ characteristics. This provides improved correction.

(Fourth Embodiment)

In the expression 10 from the third embodiment, balanced correction is provided by varying the weighting constant for the correction signal based on the polarity of gradation change, i.e., whether the change is rising or falling. The fourth embodiment uses expression 10 as a basis for providing gradation dependency and improving correction.

Expression 10 derived in the third embodiment provides different correction weighting depending on the polarity of the gradation change, but the correction signal is generated proportional to the change l'−l for high gradations.

However, when the γ value is 1.8–2.0, changes to high gradations result in higher luminance changes, as shown in FIG. 13 and FIG. 14. Thus, the size of the correction signal must be reduced according to l'−l with rising changes, and the size of the correction signal must be increased with falling changes. In embodiment 4, a non-linear function g('l,l) based on expression 10 is used to provide gradation dependency. However, the non-linear function g(l',l) must fulfill the following condition, i.e., it must be used only when there is a change in the gradation signal.

$$g(l',l)=0 \text{ if } l'=l \qquad \text{[Expression 11]}$$

In this embodiment, a quadratic function is used for non-linear function g(l',l) in order to keep the circuit implementation simple. The specific function is shown in expression 12.

[Expression 12]

$$\Delta l_i = \begin{cases} -l' & \text{if} \quad l' < l \text{ and } l' + \beta_j(l' - l)^2 < 0 \\ -\beta_i(l' - l)^2 & \text{else if} \quad l' < l \\ 255 - l' & \text{else if} \quad l' \geq l \text{ and } l' - \beta_{1r}(l' - l)(l' + l - 2\beta_{2r}) > 255 \\ -\beta_{1r}(l' - l)(l' + l - 2\beta_{2r}) & \text{else if} \quad l' \geq l \end{cases}.$$

The parameters beta f, beta 1*r*, beta 2*r* in the quadratic function used in this embodiment can be stored in a look-up table in association with different gradation changes. Alternatively, the process can be simplified by using a simple function for the different gradation changes. In order to keep the circuit scale small, the correction signal is derived using constants.

Figure 16:
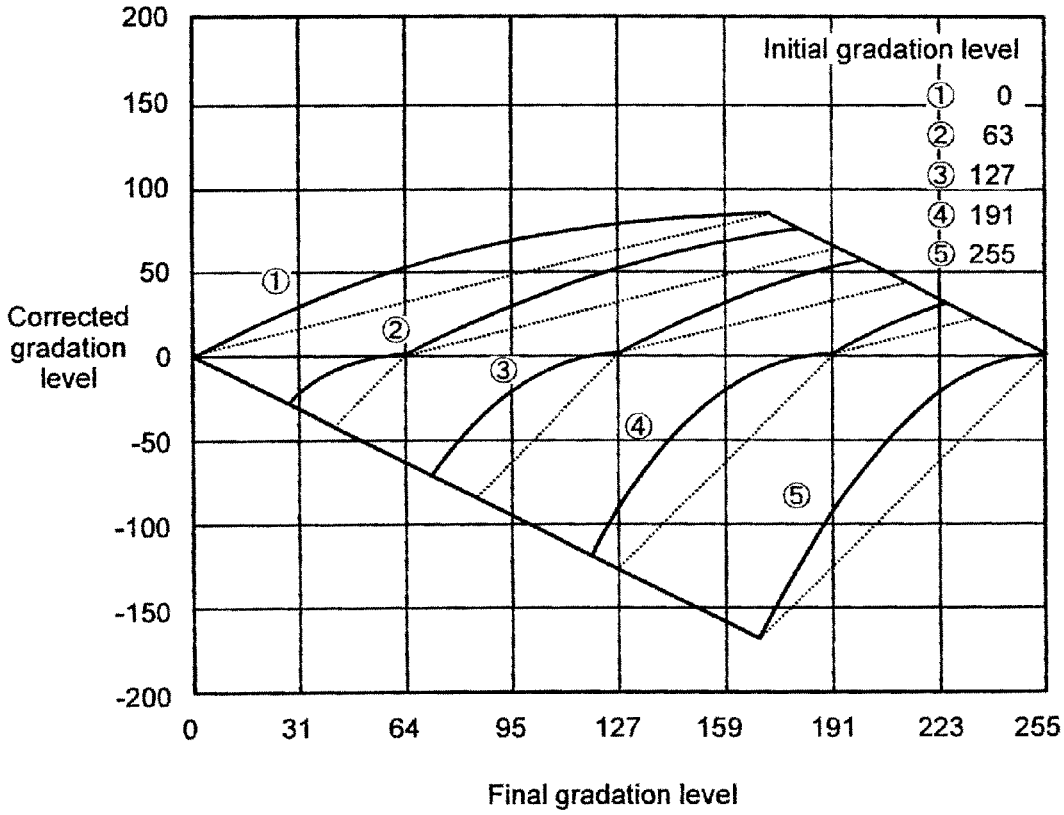
FIG. 16 is a figure illustrating the correspondence between correction signals and gradation signal changes in a fourth embodiment of the present invention.

FIG. 16 shows the correction signals for different gradation changes, as determined by expression 12.

For rising changes, the correction signal is generated with a smaller slope as the gradations become higher. For falling changes, the slope becomes greater as the changes go to the lower gradations. Thus, a correction signal is derived in a linear manner using the simple expression 9. Using this expression 9 as a basis, the γ characteristics are taken into account and different characteristics are applied depending on whether the gradation change is rising or falling. Then, the correction signal is changed in a non-linear manner relative to gradation change. This provide significant reduction in circuit scale and improved correction compared to expression 8, where the correction signal is derived directly from γ characteristics, as described in the first embodiment.

(Fifth Embodiment)

Figure 17:
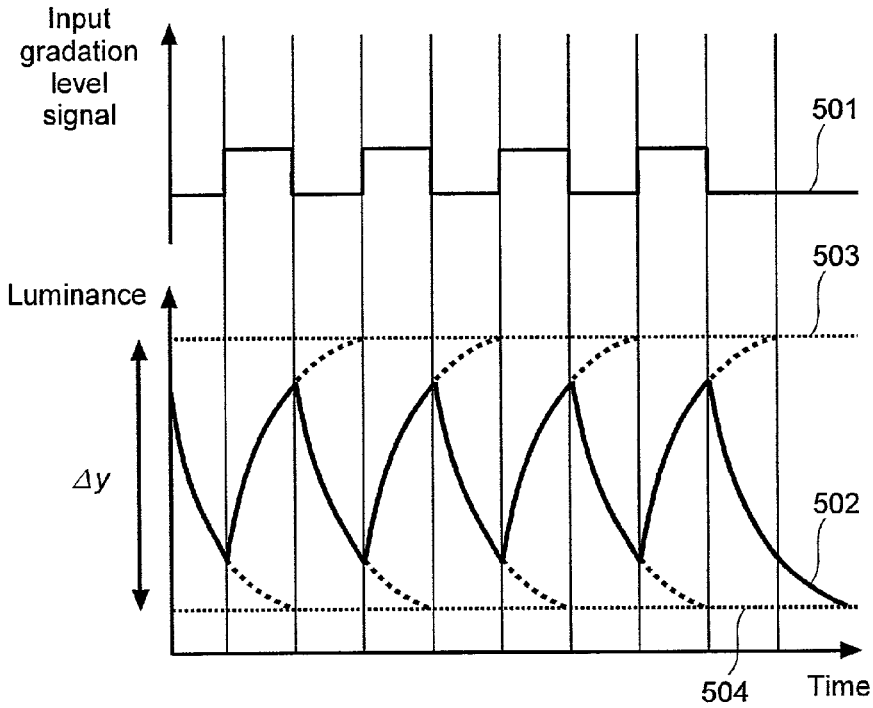
FIG. 17 is a drawing showing a luminance response curve when short gradation signal changes take place during a change period.

FIG. 17 shows an example of luminance time response when a fast-changing video is displayed.

An input signal 501 switches rapidly between a high gradation signal and a low gradation signal. A luminance response curve 502 shows the luminance response to this gradation signal.

A luminance 503 is a target luminance for when the high gradation signal is received. A luminance 504 is a target luminance for when the low gradation signal is received. Since the rate at which the gradation signal 501 changes is fast, the transition to the next change before the luminance is able to reach the target value.

Thus, the video is not able to provide the intended luminance difference of Δy, significantly reducing contrast.

In this type of fast-changing video, an adequate correction interval as in FIG. 4 cannot be provided, and the approximation shown in expression 2 will not be effective. Thus, the correction provided by the first through the fourth embodiments are inadequate.

Thus, embodiment 5 uses edge enhancement in addition to time-based correction to enhance changed sections of the video, thus improving correction.

Figure 18:
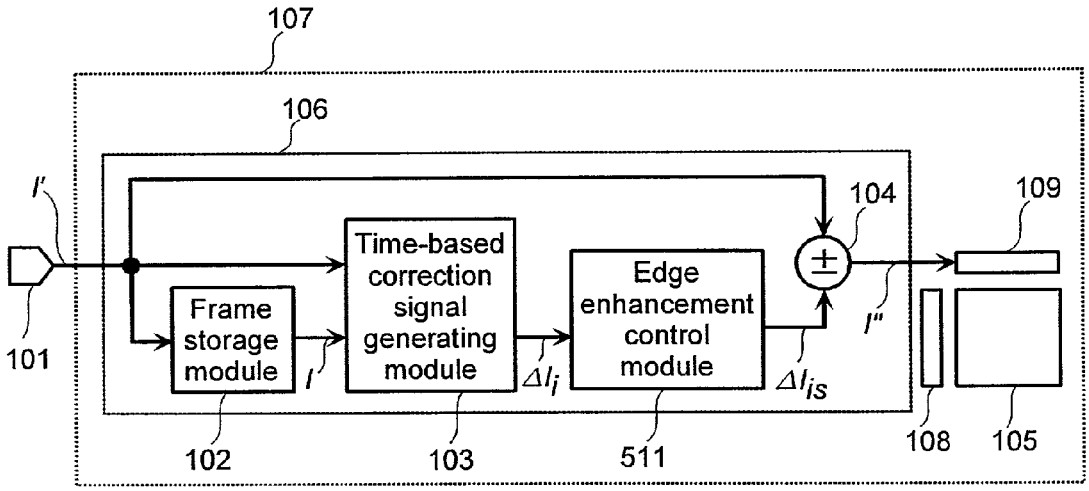
FIG. 18 is a block diagram of a correction circuit in a fifth embodiment of the present invention.

FIG. 18 shows a schematic architecture for the fifth embodiment. Element 101 through element 109 are identical to the corresponding elements from FIG. 2 and will not be described here. In the fifth embodiment, an edge enhancement control module 511 is added behind the time-based correction signal generating module 103. The edge enhancement control module 511 applies edge enhancement to the correction signal Δli generated in the same manner as in the first embodiment. This results in an edge-enhanced correction signal Δlis. This correction signal Δlis is combined with the input signal l' by the adder/subtracter 104 and the result is output to the data driver 109.

Figure 19:
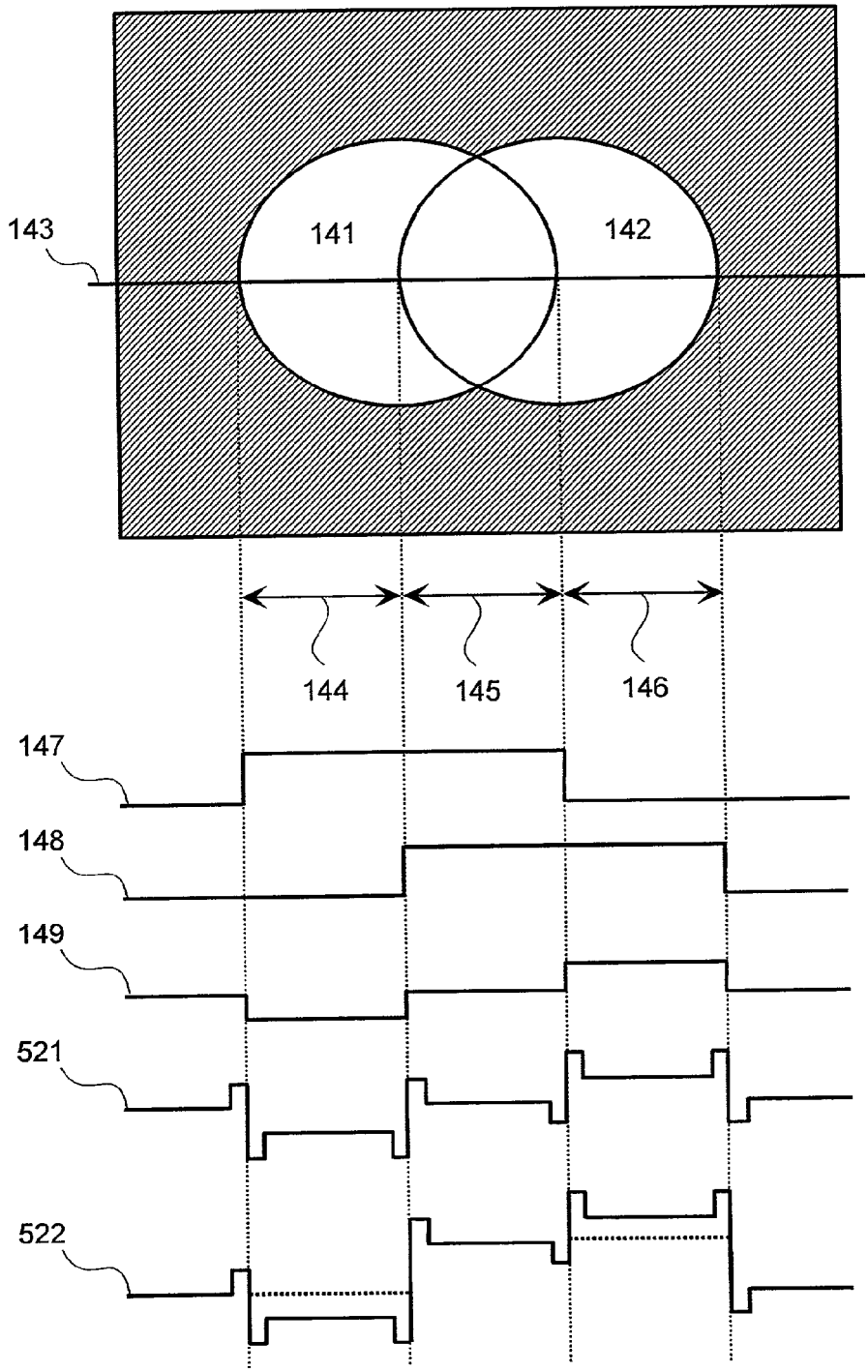
FIG. 19 is a drawing showing the spatial effect of correction performed in a fifth embodiment of the present invention.

The spatial effect of edge enhancement will be described using FIG. 19. Element 141 through element 149 are identical to the corresponding elements from FIG. 19 and will not be described here. When the video changes from the signal 147 to the signal 148, the correction signal 149 is derived based on one of the time-based correction methods described in the first through the fourth embodiments. Then, edge enhancement is performed to enhance the edges, producing a signal 521.

The edge-enhanced signal 521 is then combined with the video signal 148 to provide a corrected gradation signal 522.

Thus, the corrected gradation signal 522 includes time-based correction for changed sections as well as edge enhancement. This makes the changed sections more easily recognized. As a result, effective correction is provided for video with high rates of motion and displacement.

The degree of edge enhancement can be fixed or can be varied according to the rate of motion and displacement in the video.

This edge enhancement is performed on the correction signal as shown in FIG. 18. If there is no change in the video signal, no correction signal is generated and edge enhancement will not be applied. Thus, this embodiment provides the same wide range of applications as in the first embodiment.

(Sixth Embodiment)

Figure 20:
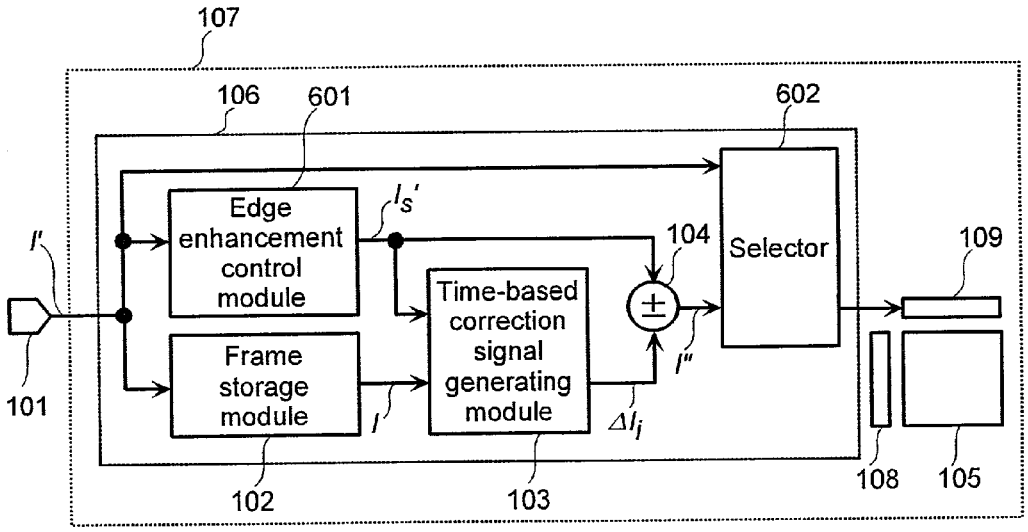
FIG. 20 is a block diagram of a correction circuit in a fourth embodiment of the present invention.

FIG. 20 shows a sixth embodiment of the present invention.

Element 101 through element 109 are the same as the corresponding elements from FIG. 2.

In the sixth embodiment, the edge enhancement control module 601 applies edge enhancement to the input signal l'. Using the video signal l from the previous frame stored by the frame storage module 102, the time-based correction signal generating module 103 provides time-based correction on edge-enhanced gradation signal Is' according to one of the methods described in the first through the fourth embodiments, thus providing the corrected signal Δli. This corrected signal is combined with the input signal l', resulting in the gradation signal l". A selection signal (not shown in the figure) from the time-based correction signal generating module 103 is sent to a selector 602 so that the selector 602 sends the corrected gradation signal l" to the data driver 109. If there is no change between the input gradation signal from the prior frame and the input gradation signal for the current frame, the gradation signal l' is output directly, thus providing conventional high quality for static images.

Figure 21:
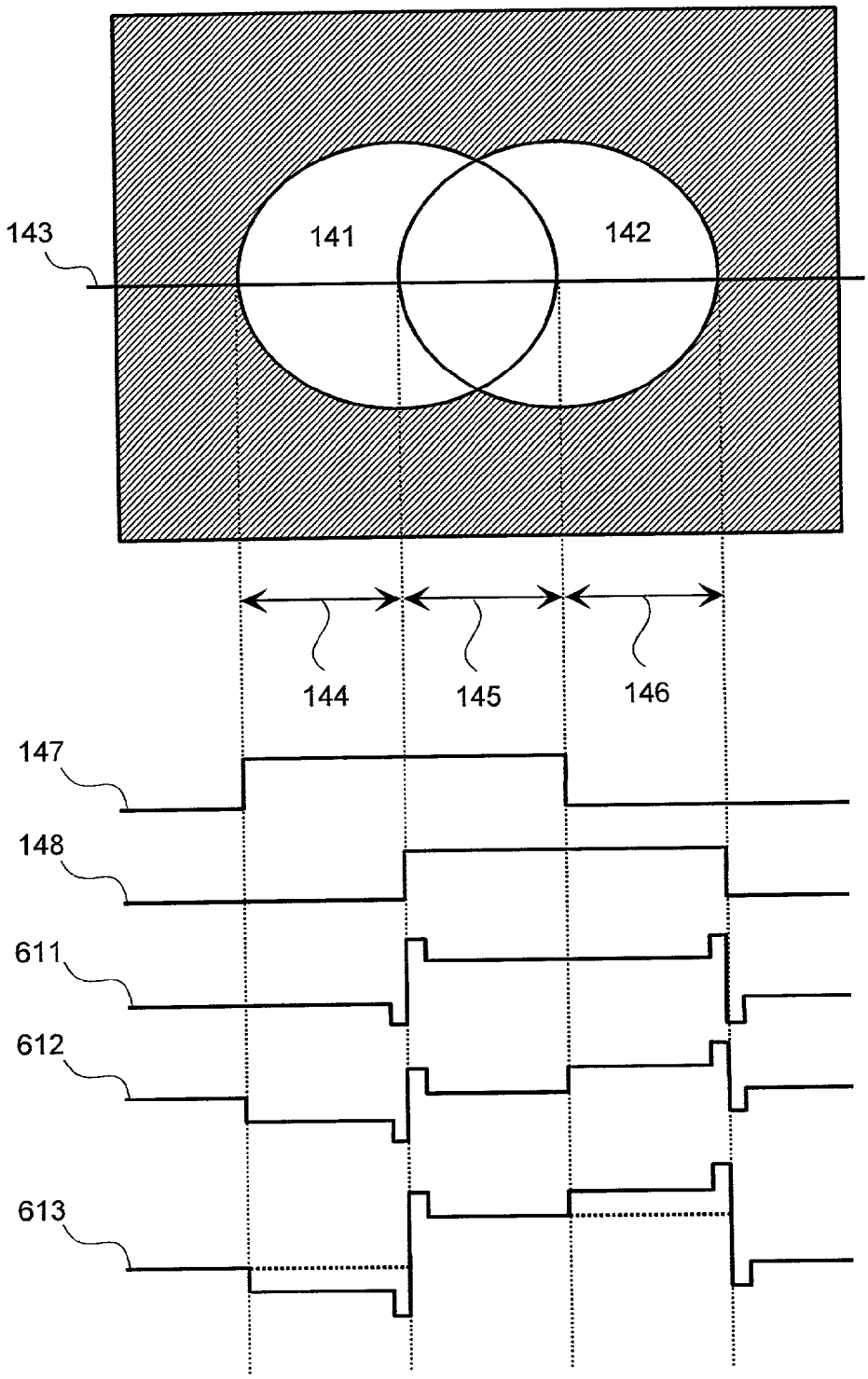
FIG. 21 is a drawing illustrating the spatial effect of correction in a sixth embodiment of the present invention.

Using FIG. 21, the spatial correction provided by this embodiment will be described. Element 141 through element 148 in FIG. 21 are identical to the corresponding elements from FIG. 11 so these elements will not be described.

In the sixth embodiment, edge enhancement is applied to the modified video signal 148 to provide an edge-enhanced video signal 611. Using this video signal 611 and the video signal 147 from the previous frame, one of the time-based correction methods described in the first through the fourth embodiments is applied, providing a corrected video signal 612. This corrected signal 612 is combined with the video signal 148 to generate a video signal 613, which is then output to the data driver 109 from FIG. 20.

In this embodiment, edge enhancement is performed directly on the video signal, and time-based correction is then applied to the edge-enhanced signal, thus providing sharp video. When the number of image elements is high, as in enlarged video, the effect of surplus/deficit luminance is significant, and the magnification also gives the video an unfocused look. Time-based correction and edge enhancement can work effectively against both these factors.

Also, since the selector 602 is used to make operations effective only when correction is needed, this embodiment provides the same wide range of applications as in the first embodiment.

(Seventh Embodiment)

Figure 22:
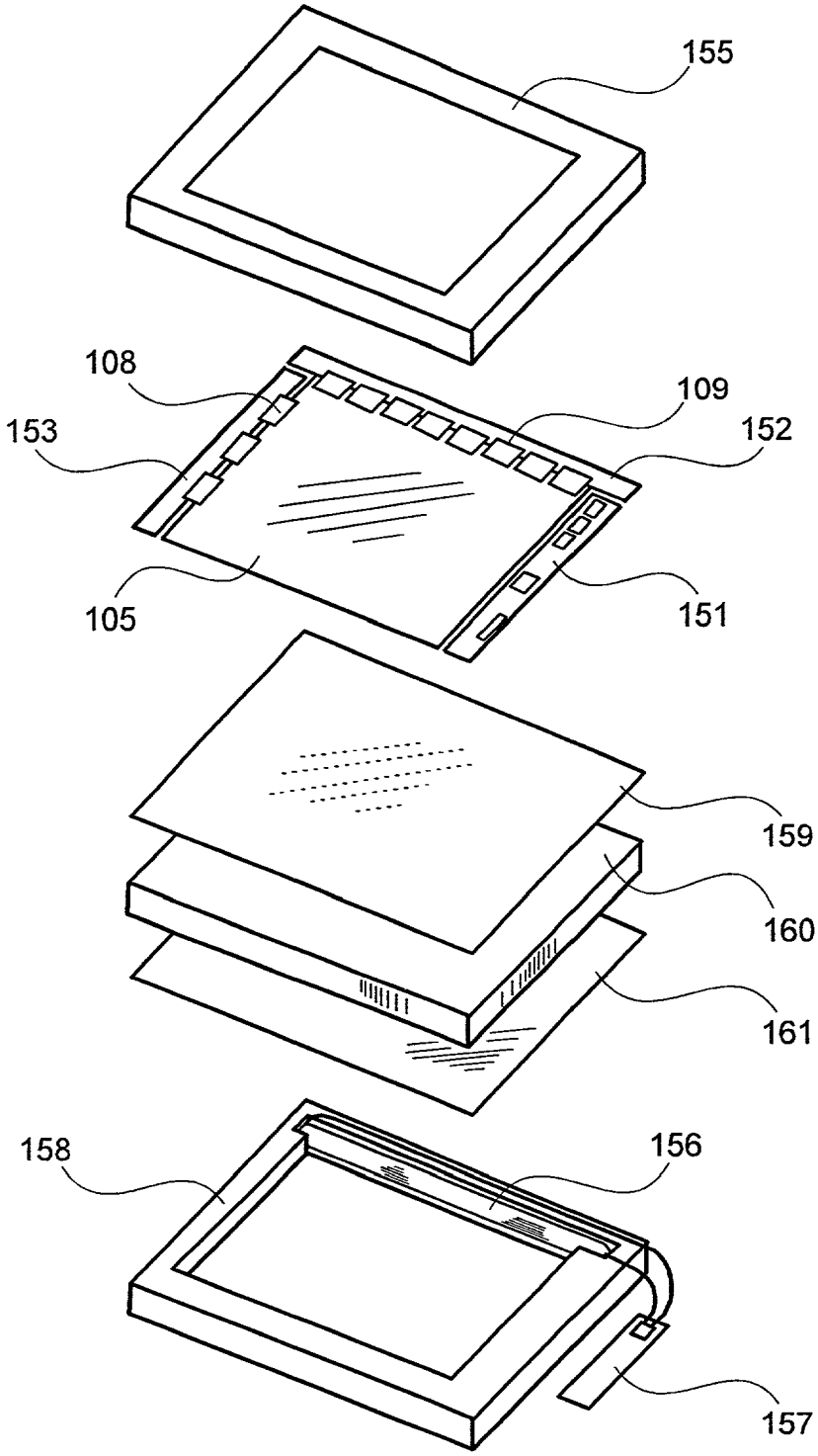
FIG. 22 is a drawing showing the architecture of a liquid crystal module in a seventh embodiment of the present invention.

FIG. 22 is an exploded diagram showing the main elements in the liquid crystal module 107 according to the present invention.

The liquid crystal module 107 includes: a liquid crystal panel 105; a data driver 109; a timing control substrate 151 on which is mounted a timing control circuit 2404 providing the power supply and signal timing control; a data substrate 152 on which is mounted the data driver; a scan driver 108; a scan substrate 153 on which the scan driver 108 is mounted; a shielded case 155 protecting the liquid crystal panel 105; a back-light fluorescent tube 156 providing illumination; an inverter 157 controlling power supplied to the back-light fluorescent tube 156; a back-light case 158 protecting the back-light fluorescent tube 156; and a diffusion panel 159, a light guide 160, and a reflective plate 161 interposed in that order between the back-light fluorescent tube 156 and the liquid crystal panel 105 to allow the light from the back-light fluorescent tube 156 to reach the liquid crystal panel 105 efficiently.

Figure 23:
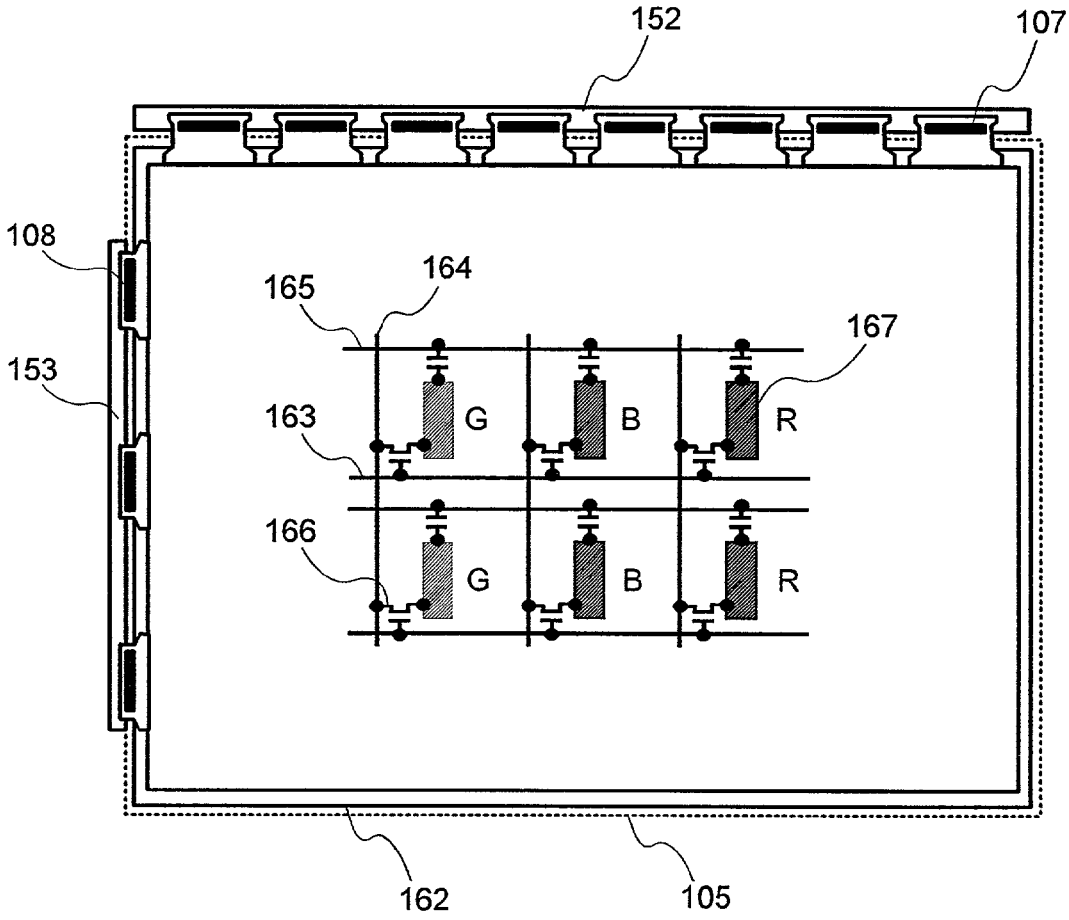
FIG. 23 is a drawing showing the architecture of a liquid crystal panel in a seventh embodiment of the present invention.

FIG. 23 shows the structure of the liquid crystal panel 107.

As shown in FIG. 22, the liquid crystal panel 107 is formed as a matrix of R (Red), G (Green), B (Blue) image element electrodes 167 arranged on a glass substrate 162. Scan signal lines 163, data signal lines 164, and common signal lines 165 are arranged vertically and horizontally. The scan signal lines 163 transfer a selection potential from the scan driver 108 to select the image element electrode 167 to apply write potential to. The data signal lines 164 transfer write potentials from the data driver 109 to selected image element electrodes based on a video signal. The common signal lines transfer common potential to associated electrodes. Thin-film transistors (TFT) 166 are disposed at the intersections of the scan signal lines 163 and the data signal lines 164. By controlling whether or not a drive potential is applied to the liquid crystal interposed between associated electrodes and an image element electrode 167, the drive potential can be applied to the selected image element and the transparency of the liquid crystal can be changed.

The scan driver supplying the selection potential is formed from a plurality of ICs (Integrated Circuits). The data driver sends write potential based on the video signal. The data driver is formed from a plurality of ICs (Integrated Circuits) mounted on the data substrate 152. The number of ICs is adequate to handle the number of data lines. The ICs are connected to the signal line terminals of the liquid crystal panel.

The timing control circuit providing power supply and timing control for the driver ICs is formed on the timing control substrate 151. The timing control circuit converts and sends the power supply, the video signal, and the sync signal from the personal computer or the like to each of the driver ICs by way of individual interfaces.

Figure 24:
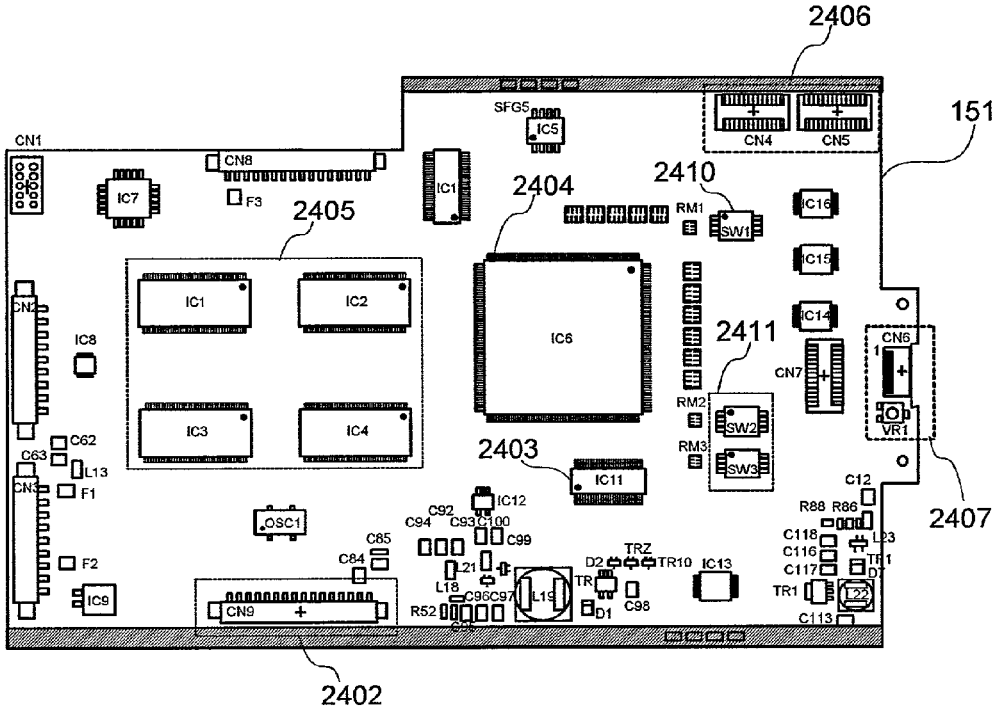
FIG. 24 is a drawing showing the architecture of a timing control circuit in a seventh embodiment of the present invention.
Figure 25:
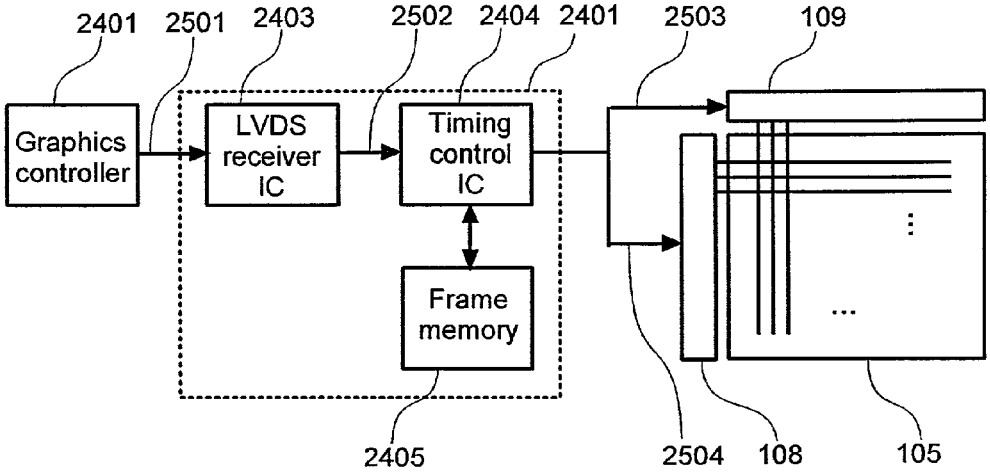
FIG. 25 is a drawing showing a signal flowchart of signals in a liquid crystal module in a seventh embodiment of the present invention.

FIG. 24 shows the overall architecture of the timing control substrate. FIG. 25 shows a signal flowchart. FIG. 24 shows a LVDS (Low Voltage Differential Signaling) connector 2402, an LVDS receiver IC 2403, a timing control circuit IC 2404, a frame memory 2405, a data driver connector 2406, and a scan driver connector 2407. Selection switches 2410, 2411 allow the control mode of the timing control substrate 151 to be selected.

In FIG. 25, a graphic controller 2401 in the personal computer or the like controls the video signal and the sync signal thereof. If video signal from the graphics controller 2401 is an analog or a digital signal, or a digital signal, it will be sent through a CMOS (Complementary Metal Oxide Semiconductor) interface or an LVDS interface. This embodiment will be described with an LVDS interface.

The LVDS receiver IC 2403 receives an LVDS signal 2501 from the LVDS connector 2402 and converts the signal to a CMOS signal 2502. The converted signal is sent to the timing control circuit 2404.

The timing control circuit 2404 accesses the frame memory 2405 as needed and controls the video signal, the data driver, and the scan driver by sending control signals 2503, 2504 through the data driver connector 2406 and the scan driver connector 2407, thus controlling the drivers driving the liquid crystal panel.

Figures 26, 27:
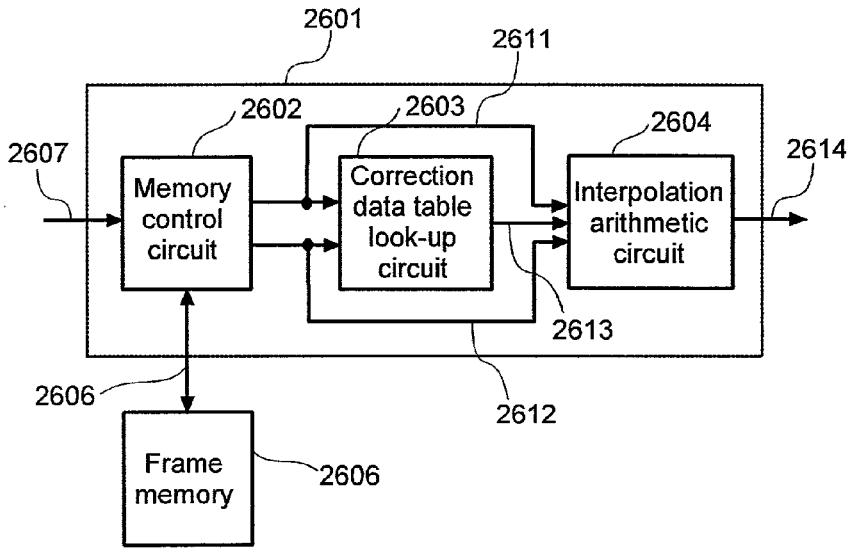
FIG. 26 is a block diagram showing the functional architecture of a data correction circuit in a seventh embodiment of the present invention.
FIG. 27 is a drawing showing a correction data table look-up circuit in a seventh embodiment of the present invention.

FIG. 26 is a block diagram of the data correction function in the timing control circuit 2404 as implemented in the present invention. A data correction module 2601 corresponds to the module 106 from FIG. 2(*a*) and includes a memory control module 2602, a correction table look-up circuit 2603, and a correction arithmetic module 2604. A frame memory 2606 is installed external to the timing control circuit 2404 but can be installed within the timing control circuit 2404 if necessary.

Next, the operations of the data correction module will be described. The data correction module 2601 receives the R, G, B gradation signals and sync signals such as CLK, HSYNC, and VSYNC (not shown in the figure) as input. The frame memory 2606 can be accessed by way of the memory control module 2602 to provide a one-frame delay in the video signal. The memory control module 2602 uses the memory access feature of the frame memory 2606 to efficiently perform read/write operations by way of the data and address bus 2609 as well as rear/write and access control buses (not shown in the figure). Current frame data 2611 and single-frame delay data 2612 are sent at the same time to the correction data table look-up circuit 2603 and the correction arithmetic module 2604.

The correction data table look-up circuit 2603 holds a correction data table and retrieves a correction table data set 2613, needed for the subsequent correction arithmetic module 2604, based on the current frame data 2611 and the previous frame data 2612. The correction arithmetic module 2604 provides correction by performing interpolations from the current frame data 2611 and the previous frame data 2612. The timing of corrected data 2614 is converted for driver control and sent to the different drivers.

FIG. 27 shows an example of correction data entered in the correction data table look-up circuit 2603. In this example, the data is assumed to be 8-bit data and forms a 9×9 matrix determined by nine samples of pre-change gradation data indicated in the table rows and nine samples of post-change gradation data indicated in the table columns.

Figure 28A:
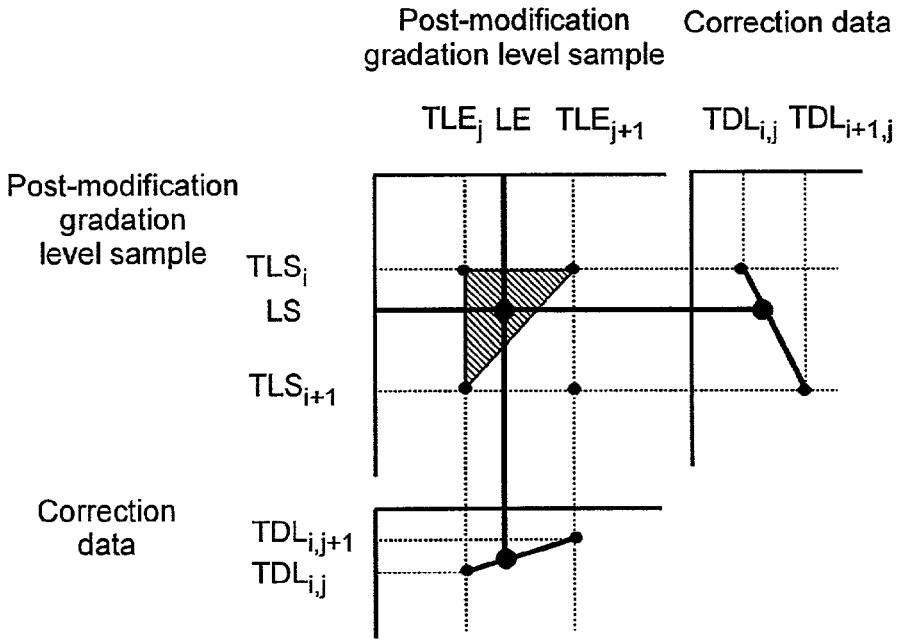
FIG. 28 is a drawing for the purpose of describing the interpolation method used in a seventh embodiment of the present invention.
Figure 28B:
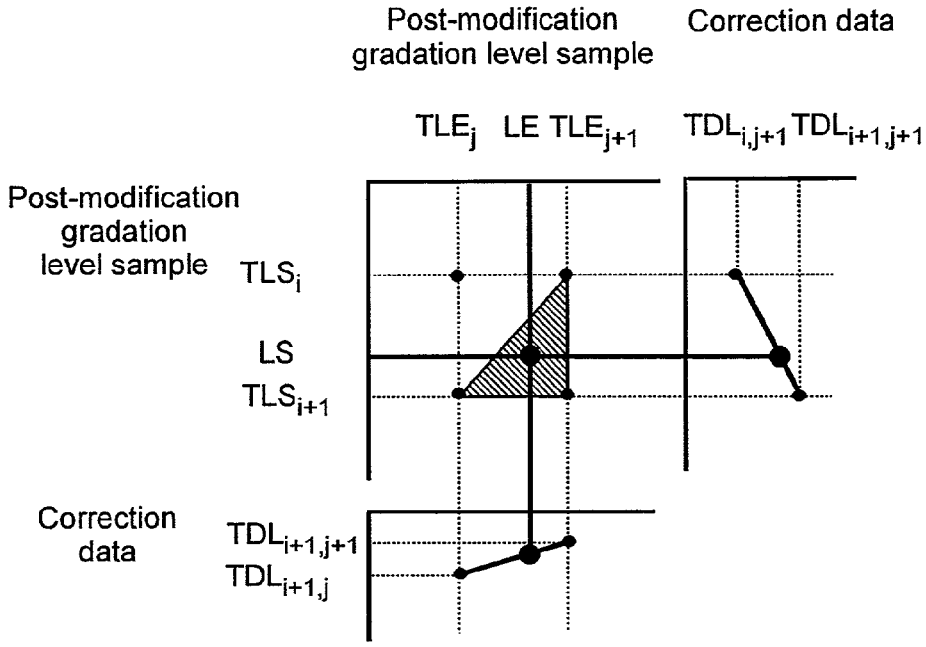

FIG. 28 shows a sample correction table data set retrieved from the correction data table look-up circuit 2603 and an example of a correction calculation method performed by the correction arithmetic module 2604 using this correction table data set. FIG. 28A illustrates the interpolation method used when the condition shown in expression 13 is satisfied, i.e., when a pre-modification gradation data LS and a post-modification gradation data LE are positioned within a shaded region A, where gradation sample data TLSi is the closest value less than LS, gradation sample data TLSi+1 is the closest value larger than LS, gradation sample TLEj is the closest value less than LE, and gradation sample TLEj+1 is the closest value greater than LE. Similarly, FIG. 28B illustrates the interpolation method used when the data does not satisfy expression 13, i.e., is located within a shaded region B.

$$(TLE_{j+1}-TLE_j)(LS-TLS_i)+(TLS_{i+1}-TLS_i)(LE-TLE_{j+1}) \leqq 0 \quad \text{[Expression 13]}$$

In FIG. 28A, interpolated correction data DL is expressed as shown in expression 14, using correction table data TDLi,j for gradation sample data TLSi, TLEj, correction table data TDLi+1,j for gradation sample data TLSi+1, TLEj, and correction table data TDLi,j+1 for gradation sample data TLSi, TLEj+1.

[Expression 14]

$$DL = TDL_{i,j} + \frac{TDL_{i+1,j} - TDL_{i,j}}{TLS_{i+1} - TLS_i}(LS - TLS_i) + \frac{TDL_{i,j+1} - TDL_{i,j}}{TLE_{j+1} - TLE_j}(LE - TLE_j)$$

In FIG. 28B, the interpolated correction data DL is expressed as shown in expression 15, using TDLi+1,j, TDLi,j+1 as described above and correction table data TDLi+1,j+1 for gradation sample data TLSi+1, TLEj+1.

[Expression 15]

$$DL = TDL_{i+1,j+1} - \frac{TDL_{i+1,j+1} - TDL_{i,j+1}}{TLS_{i+1} - TLS_i}(TLS_{i+1} - LS) - \frac{TDL_{i+1,j+1} - TDL_{i+1,j}}{TLE_{j+1} - TLE_j}(TLE_{j+1} - LE)$$

While the interpolation functions in expression 14 and expression 15 use linear functions, it goes without saying that the present invention is not restricted to this.

Figure 29:
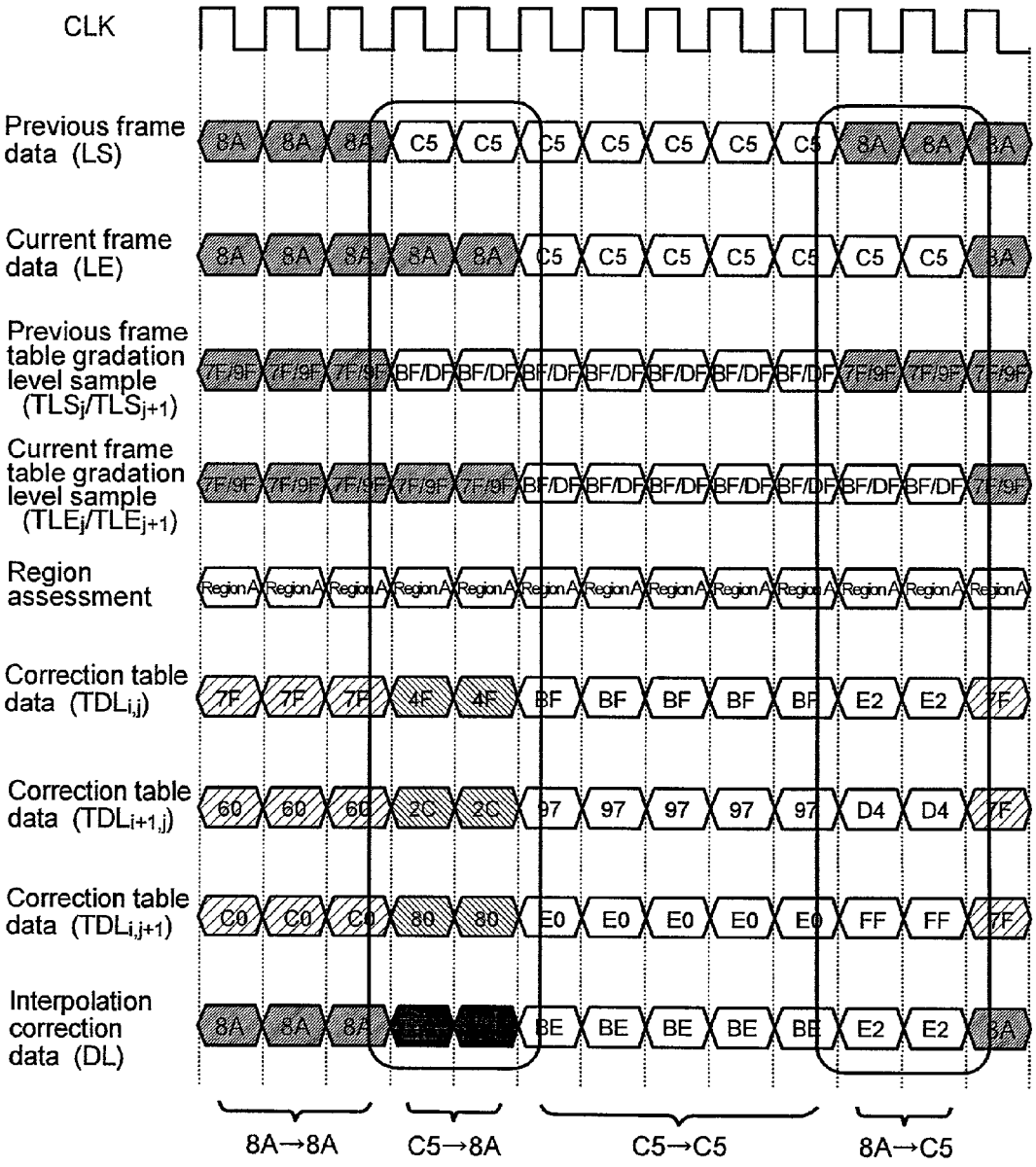
FIG. 29 is a timing chart of a correction operation in a seventh embodiment of the present invention.

FIG. 29 shows a timing chart for the data correction operation performed by the correction data table look-up circuit 2603 and the correction arithmetic module 2604 from FIG. 26. In FIG. 29, CLK is the clock used for synchronizing by dots. Corrected data is generated at the start of a clock cycle. In practice, completing processing within a single clock cycle is often difficult due to the bit lengths used in the arithmetic, the clock frequency, and the like. In order to simplify the description of this embodiment, however, it will be assumed that processing is completed within one clock cycle.

As an example, if frame data is transferred from the memory control module 2602 as shown in FIG. 29, there would be four types of data changes: 8A(HEX) to 8A(HEX), C5(HEX) to 8A(HEX), C5(HEX) to C5(HEX), and 8A(HEX) to C5(HEX). Of these changes, the increase from 8A(HEX) to C5(HEX) will be considered. If the table shown in FIG. 27 is entered in the correction data table look-up circuit 2603, the pre-modification gradation samples TLSi, TLSi+1 will be 7F(HEX) and 9F(HEX) respectively. The post-modification gradation samples TLEj, TLEj+1 will be BF(HEX) and DF(HEX) respectively. The pre-modification and post-modification gradation data 8A(HEX), C5(HEX) fulfill expression 13 based on the gradation data sample set 7F(HEX), 9F(HEX), BF(HEX), DF(HEX) as described above, and are therefore positioned within the region A in FIG. 28. Thus, in this case expression 14 is used. Based on the data table in FIG. 26, E2(HEX), D4(HEX), and FF(HEX) are used for correction table data DLi,j, DLi+1,j, and DLi,j+1 respectively, and the interpolated corrected data E2(HEX) is output. The E2(HEX) data output from this correction circuit is larger than the expected output of C5(HEX), thus allowing the luminance deficit from the image change to be corrected. Similarly, a decrease from C5(HEX) to 8A(HEX) generates an output data of 59(HEX), which is smaller than the expected output of 8A(HEX), thus allowing the luminance surplus to be canceled out.

In this manner, this embodiment uses discrete correction table data to correct all data using interpolation operations. This allows the size of the correction data table look-up circuit to be relatively small, and allows it to be built into the timing control circuit 2404.

(Eighth Embodiment)

In the seventh embodiment, the correction data is obtained by interpolating from the correction table data even if there is no modification in the video signal. However, the eighth embodiment uses a method for correction is performed only if there is a modification.

As shown in FIG. 29, even if there is no change the data generated through interpolation will not necessarily be the same as when no correction is applied. For example, going from C5(HEX) to C5(HEX) involves no modification of the image itself but the resulting data will be converted to BE (HEX). The reason for this is quantization error in the operations performed in expression 14 and expression 15. To overcome this, the error may be reduced by increasing the bit length used in arithmetic operations, but this will involve sacrifices in the size of the arithmetic circuit and processing speed. Thus, in this embodiment, if there is no image modification, the video signal is output directly, with correction being applied only if there is image modification.

Figure 30:
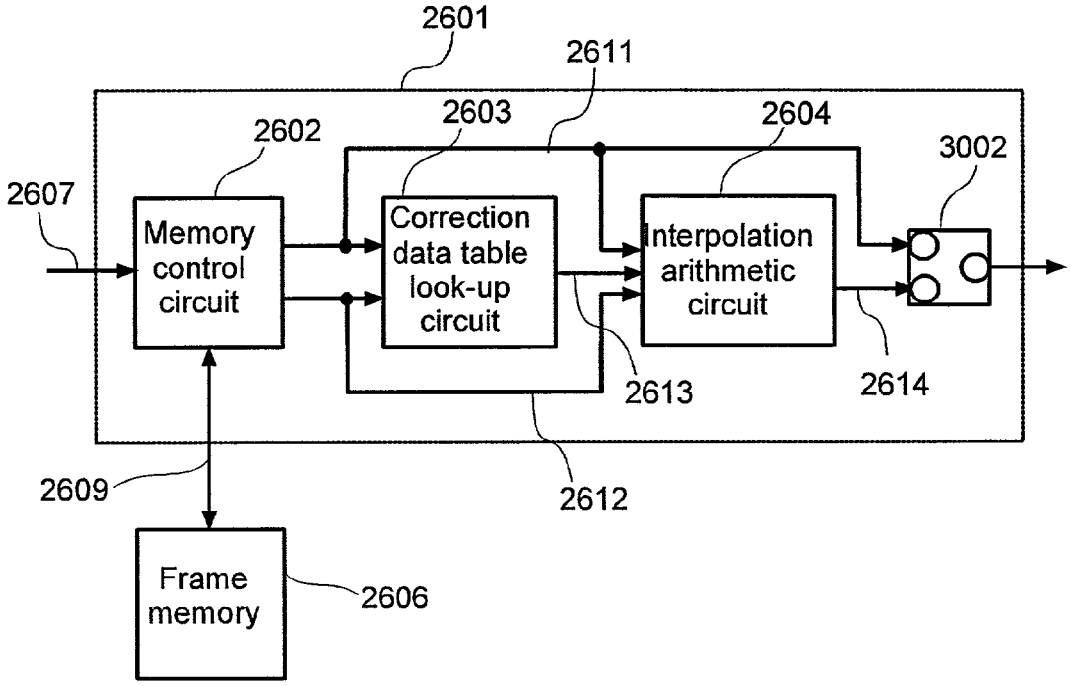
FIG. 30 is a block diagram showing the functional architecture of a data correction circuit in an eighth embodiment of the present invention.

FIG. 30 is a functional block diagram of the improved data correction circuit of this embodiment. In FIG. 30, a selector 3002 is added to FIG. 26. The selector 3002 is disposed after the correction arithmetic module and provides a switching feature where the input data is output directly if there is no image modification and applies correction operations only when image modifications are present.

Figure 31:
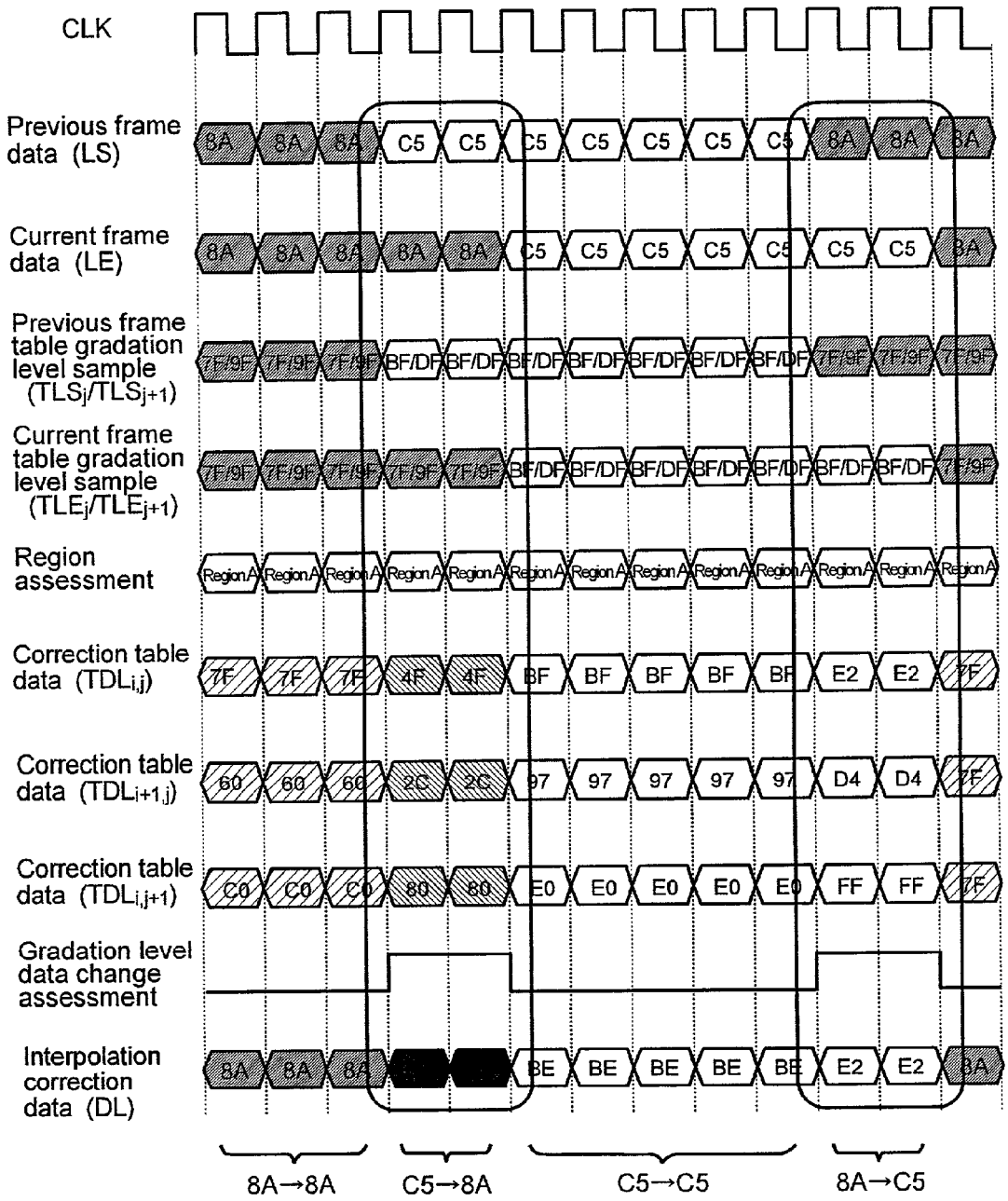
FIG. 31 is a timing chart of a correction operation in an eighth embodiment of the present invention.

The signal processing flow in this embodiment will be described with reference to the timing chart shown in FIG. 31. The correction of data using the correction table data and the correction arithmetic are similar to that of FIG. 29 so the description will be omitted. In FIG. 31, if the data stays unchanged, e.g., from 8A(HEX) to 8A(HEX) or C5(HEX) to C5(HEX), then the selector 3002 does not output corrected data and instead outputs the current frame data directly. By doing this, gradation offsets are prevented if the images do not change, while luminance can be corrected as before if the images do change.

(Ninth Embodiment)

Directly implementing the correction data look-up circuit tends to result in a large-scale circuit. In this embodiment, linear approximation is performed for the correction data for different gradation data changes, and the slopes are used to generate a slope data table, thus reducing the size of the table.

Figure 32:
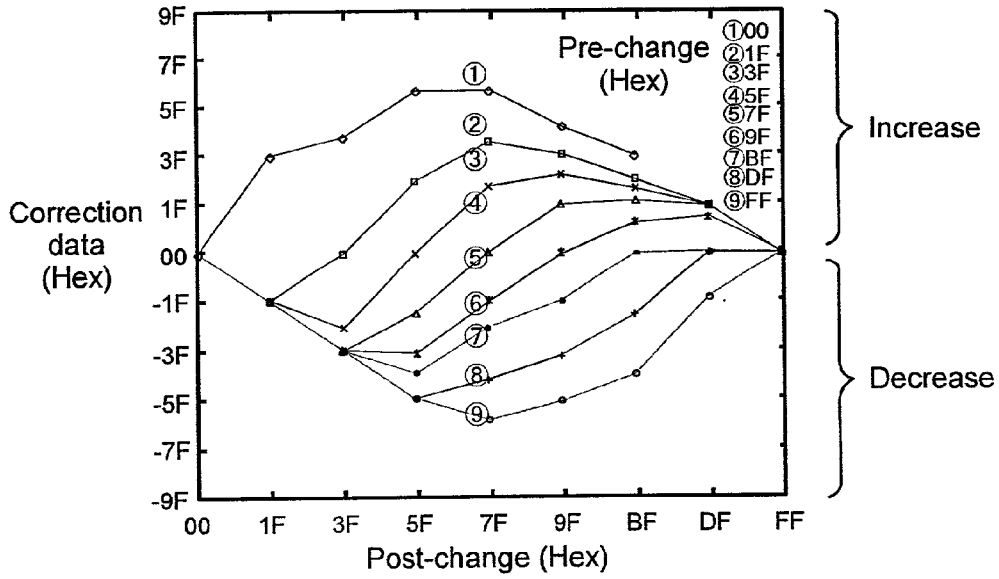
FIG. 32 is a figure illustrating correction data measurement values in an eighth embodiment of the present invention.

FIG. 32 shows correction data for different gradation changes obtained through testing. The figure shows the correction data indicated in the vertical axis that is needed to provide correction for the transition from the pre-change gradation data indicated in (1)–(9) to the post-change gradation data indicated in the horizontal axis. In this embodiment, the correction data referred to here is the data to be added to the post-change gradation data. For example, for a gradation change from 00(HEX) to 1F(HEX), FIG. 32 indicates that a correction of 3F(HEX) is needed, but the final output will be 5E(HEX), calculated by adding the correction data 3F(HEX) to the post-change gradation data 1F(HEX). It is assumed that the gradation data is 8-bit data, so correction data can only be generated within the range of 00(HEX) to FF(HEX). Since adequate correction values are not available for changes to high gradations and changes to low gradations, the correction data shown in FIG. 32 is within the available range of correction data that can be generated.

Figure 33:
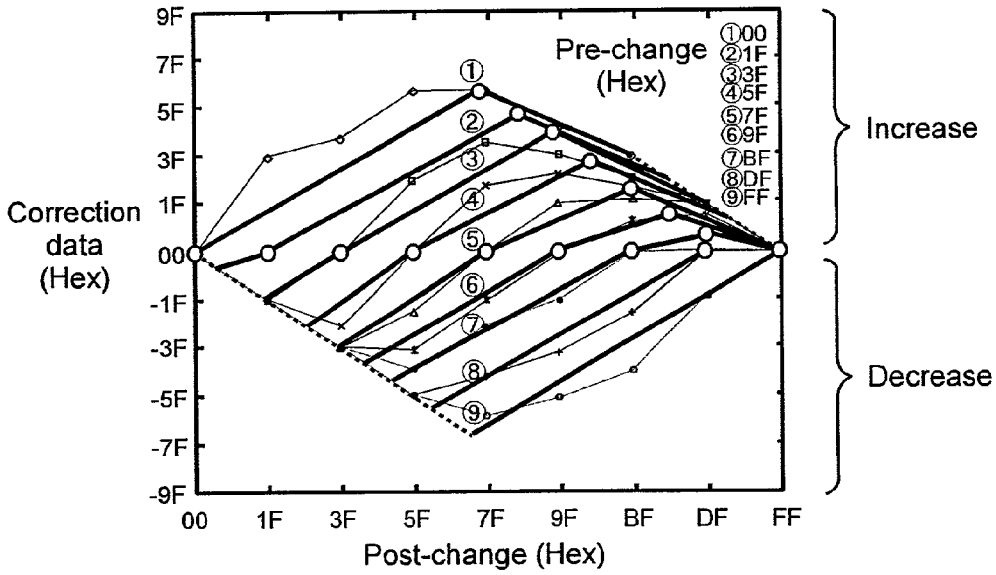
FIG. 33 is a figure illustrating an approximation line for correction data in a ninth embodiment of the present invention.

FIG. 33 shows the correction data for gradation changes determined by linear approximation from FIG. 32. Generally, the relation between gradation data and luminance data roughly follows a curve expressed by a parameter γ, where γ is approximately 1.8–2.2. In other words, luminance change is greater for gradation changes to higher luminance gradations. Thus, correction data can be small when the gradation change is an increase, particularly to a high luminance. As a result, an approximation is a bent line where the bend is at an intermediate point between the pre-change gradation data and the maximum gradation data. For decreases, there is more linearity in correction data compared to increases, so approximation is more linear. These aspects are expressed in expression 16.

[Expression 16]

$$DL = \begin{cases} \text{if } LE < LS : M1_i(LE - LS) \\ \text{else if } LS \le LE < \dfrac{LMAX + LS}{2} : M2_i(LE - LS) \\ \text{else if } LE \ge \dfrac{LMAX + LS}{2} : M2_i LMAX - \dfrac{LS}{2} - M3_i\left(LE - \dfrac{LMAX + LS}{2}\right) \end{cases}$$

Figures 34, 35:
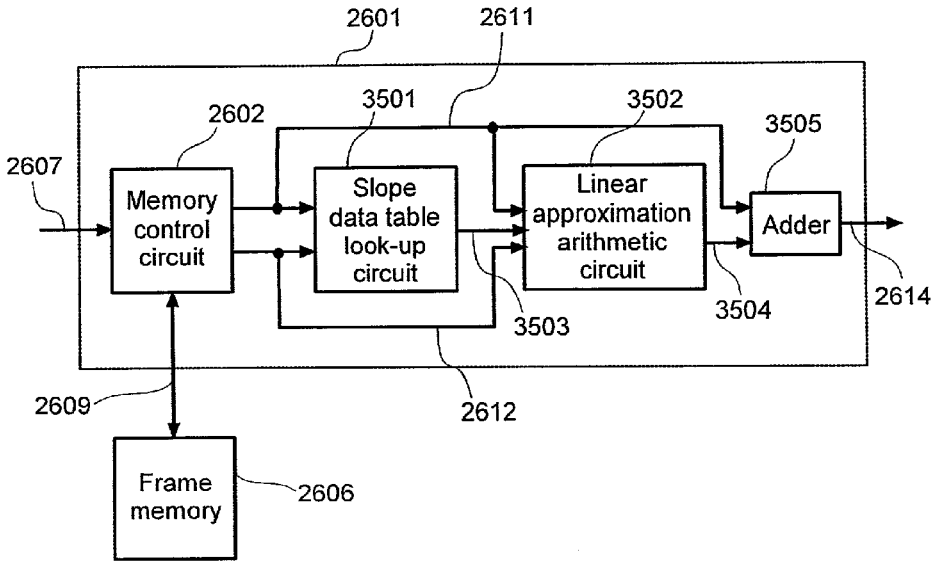
FIG. 34 is a figure illustrating a correction data approximation line slope table in a ninth embodiment of the present invention.
FIG. 35 is a block diagram showing the functional architecture of a data correction circuit according to a ninth embodiment of the present invention.

In expression 16, DL represents correction data, i represents a linear slope table index, M1 represents linear slope table data (for decreases), M2 and M3 represent bent-line slope table data (for increases), LMAX represents maximum gradation data, LS represents pre-change gradation data, and LE represents post-change gradation data. FIG. 34 shows an example of a linear slope data table. The slope data table in FIG. 34 is a table with nine pre-change gradation data entries, so one of the nine entries in the table must looked up for all gradation changes. In this description, table look-up will be based simply on the upper three bits of the pre-change gradation data. In this embodiment, gradation increases involve a bent line with one node and decreases involve linear approximation. However, the present invention is of course not restricted to this.

FIG. 35 shows a block diagram of a data correction circuit that implements the approximation correction of this embodiment. The figure shows a linear approximation slope data table look-up circuit 3501, corresponding to what is shown in FIG. 34, and an approximation arithmetic module 3502. The circuit 3501 contains a slope data table which sends slope data 3503 corresponding to previous frame data and current frame data obtained from the memory control module 2602 to the approximation arithmetic module 3502. The approximation arithmetic module 3502 performs the operations indicated in expression 16 to calculate correction data 3504. In this embodiment, the correction data is generated on the assumption that it will be combined with the current frame data, so an adder 3505 must output the sum of the correction data and the current frame data 2611.

Figure 36:
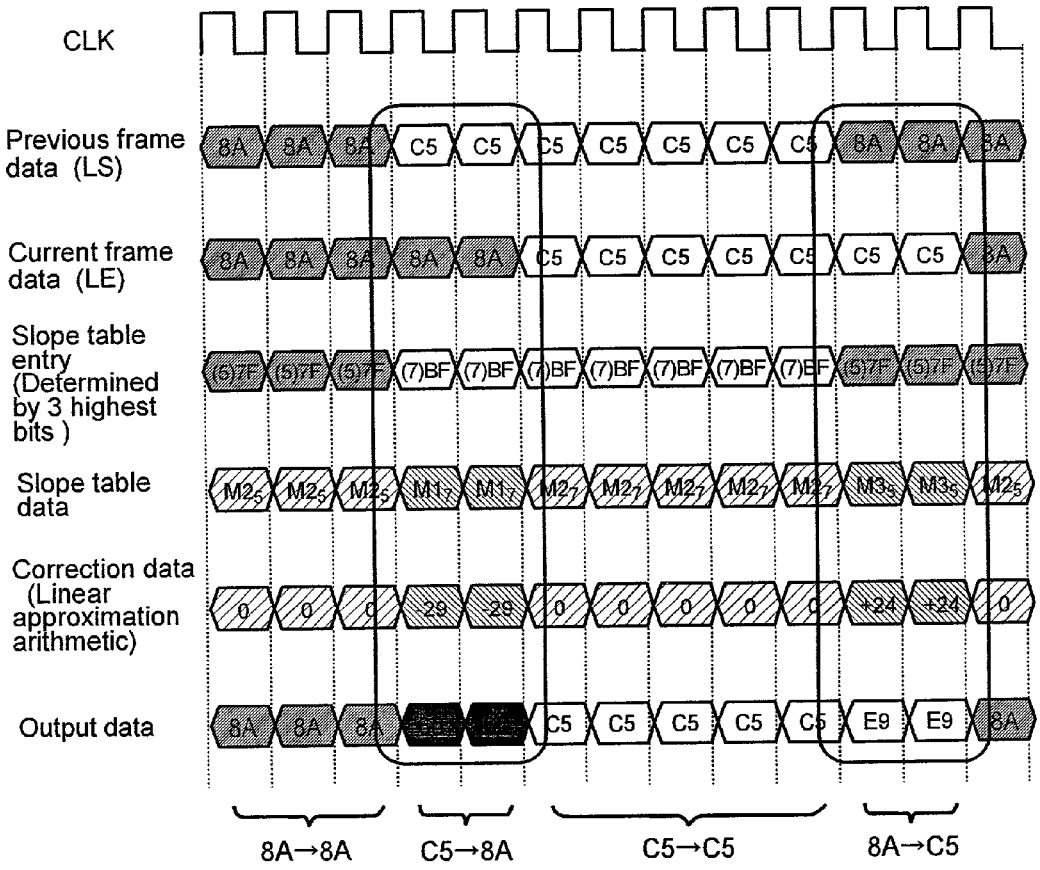
FIG. 36 is a timing chart of a correction operation in a ninth embodiment of the present invention.

The data correction process performed by this correction circuit is illustrated in the timing chart shown in FIG. 36. Signals corresponding to previously described signals will not be described here. In FIG. 36, a slope table entry is retrieved from the previous frame data. As described earlier, this embodiment uses the three highest bits of the previous frame data to allow easy selection of a table entry. For example, in the case of a decreasing change from C5(HEX) to 8A(HEX) as shown in FIG. 36, the table entry is determined from 6(HEX), the three highest bits. This corresponds to the seventh entry (7) BF(HEX) in FIG. 34.

Next, the slope data is retrieved from the table entry determined using the previous frame data and the current frame data. In this case, the change is decreasing, so the slope will be 88/CO(HEX), as shown in FIG. 34. This slope data is used to perform the approximation arithmetic shown in expression 16, providing a correction data of −29(HEX). Finally, this correction data is added to the current frame data, resulting in an output of 61(HEX). Similarly, in the case of an increasing change, e.g., an increase from 8A(HEX) to C5(HEX), the fifth table entry will be selected. In this case, the slope data 30/50(HEX), 30/50(HEX) will be used in expression 16, resulting in correction data +24 (HEX), which is then added to the current frame data, resulting in an output of E9(HEX). As shown in FIG. 36, this correction method that uses approximation requires fewer table accesses and calculations compared to FIG. 29 and FIG. 31. This reduces the scale of the circuitry.

(Tenth Embodiment)

When the parameter γ relating gradation and luminance is in the range of 1.8–2.2, smaller correction data is needed for changes to higher gradations, as indicated in FIG. 32. Thus, correction data has a peak value at a certain gradation and then the corrections decrease as the gradations increase. In this embodiment, a quadratic expression is generated for this characteristic to approximate the relation between gradation change and correction data. As in the eighth embodiment, the correction data in this embodiment is combined with the post-change gradation data.

Figures 37, 38:
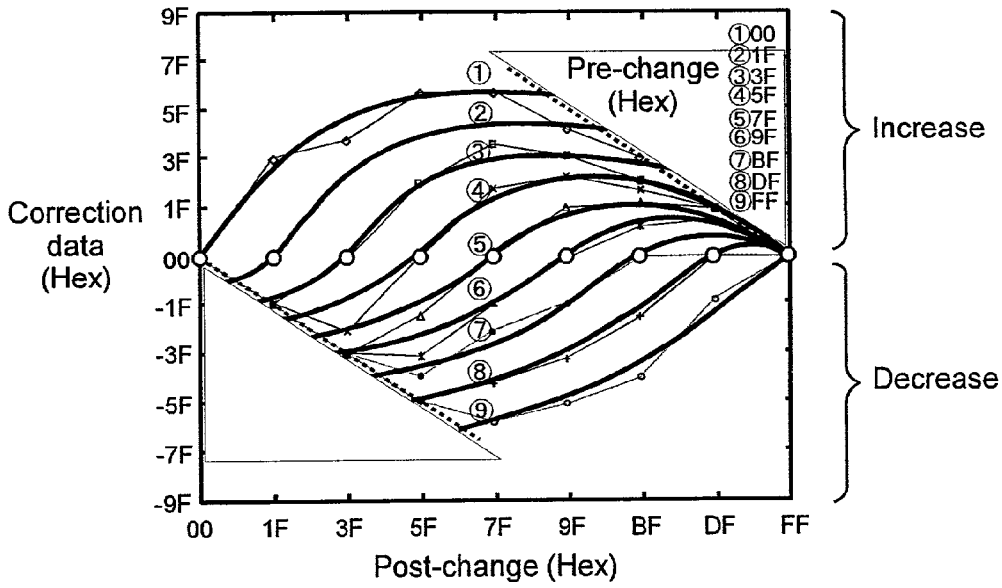
FIG. 37 is a figure showing a correction data quadratic approximation curve in a tenth embodiment of the present invention.
FIG. 38 is a quadratic coefficient data table for correction data quadratic approximation curves in a tenth embodiment of the present invention.

FIG. 37 shows a set of quadratic approximation functions. In the approximations in this embodiment, quadratic functions having a center line at an intermediate point between the pre-change gradation data and the maximum gradation data FF(HEX) are used for increasing changes. For decreasing change, quadratic functions having a center line at the minimum gradation data 00(HEX) are used. Expression 17 shows more specific details.

[Expression 17]

$$DL = \begin{cases} \text{if } LE < LS : A1_i(LE^2 - LS^2) \\ \text{else if } LS \le LE : -A2_i\left\{\left(LE - \frac{LS + LMAX}{2}\right)^2 - \left(\frac{LS - LMAX}{2}\right)^2\right\} \end{cases}$$

In expression 17, DL represents correction data, i represents a quadratic coefficient table index, A1 represents quadratic coefficient table data (decreasing change), A2 represents quadratic coefficient table data (increasing change), LMAX represents maximum gradation data, LS represents pre-change gradation data, and LE represents post-change gradation data. If there is no change in gradation data, expression 17 takes into account the following condition where correction data is 0. Thus, gradation offsets are prevented in cases where the images do not change.

$$DL=0 \text{ if } LS=LE \qquad \text{[Expression 18]}$$

The approximation function can also be a non-linear function other than the quadratic function shown in expression 17 that fulfills the condition in expression 18.

FIG. 38 shows an example of a quadratic coefficient data table. The table in FIG. 38 contains nine quadratic coefficient entries, and all pre-change gradation data must correspond to one of these nine entries. In this embodiment, an entry is selected based on the three highest bits of the pre-change gradation data, and the corresponding quadratic coefficient table data is used to perform approximation.

Figure 39:
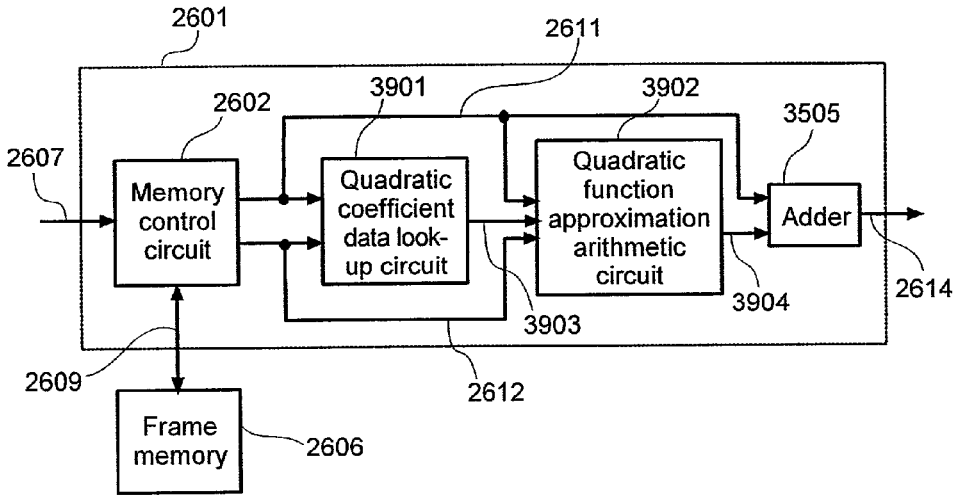
FIG. 39 is a block diagram showing the functional architecture of a data correction circuit in a tenth embodiment of the present invention.

FIG. 39 is a functional block diagram of a data correction circuit implementing this approximation operation. A quadratic coefficient data table look-up circuit 3901 corresponds to what is shown in FIG. 38. An arithmetic module 3902 performs the quadratic operation shown in expression 17. The details of FIG. 39 are similar to those of the linear approximation operation illustrated in FIG. 35, so the corresponding descriptions will be omitted here. The quadratic coefficient data table look-up circuit 3901, which contains a quadratic coefficient data table, determines whether there is an increasing or decreasing change between the previous frame data 2612 and the current frame data 2611, and then passes on the quadratic coefficient data 3903 to be used for approximated to the quadratic arithmetic module 3902. Using the received coefficient data 3903, the quadratic arithmetic module 3902 uses the appropriate function shown in FIG. 17 depending on whether the change is increasing or decreasing and outputs the results as correction data 3904. In this embodiment, final output data 2614 from the correction circuit 2621 is generated by adding the correction data to the current frame data. Thus, the adder 3505 adds the current frame data 3611 to the correction data 3904 and outputs the sum.

Figure 40:
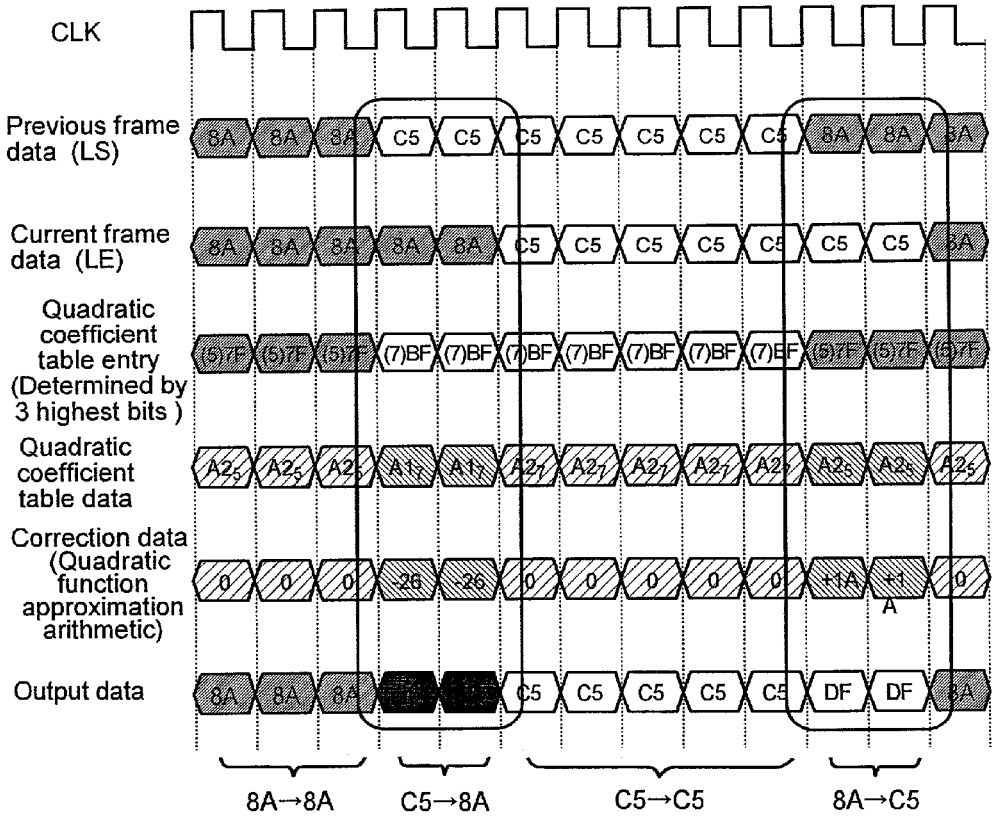
FIG. 40 is a timing chart of a correction operation in a tenth embodiment of the present invention.

FIG. 40 is a timing chart illustrating the operations performed in this approximation method. For example, a decreasing change in gradation data from C5 to 8A will be considered. Since the quadratic coefficient table entry is selected using the three highest bits in the pre-change gradation data, the seventh table entry from FIG. 38 is selected. Since the change is a decreasing change, a coefficient 1/200(HEX) is selected, and the operations indicated in expression 17 is carried out by the quadratic function approximation arithmetic module to determine a correction data of −26(HEX). Finally, the correction data is added to the current frame data at the last stage of the correction circuit, and 64(HEX) is output. Similar operations are performed for increasing changes. For example, in an increase from 8A(HEX) to C5(HEX), the fifth table entry is selected and a coefficient of 4/200(HEX) is used. The correction data is calculated as +1A(HEX), and the final output is generated as DF(HEX).

This embodiment uses non-linear functions to allow easy approximation of correction data for different gradation changes. This simplifies the data table and reduces the circuit scale.

(Eleventh Embodiment)

The correction circuit using a data table must be formed to process R, G, and B sub-pixels in parallel. This can lead to increased circuit size. Also, a change in the parameter γ, which represents the relation between the optic response characteristics of the liquid crystal, gradation, and luminance, requires a reconstruction of the correction table. In this embodiment, correction is performed using a digital filter having a transfer function with an order of at least one.

[Expression 19]

$$H(z) = 1 + K(1 - z)$$

$$K = \frac{\alpha\tau}{T_f}$$

H(z) represents the transfer function, K represents a filter coefficient, Tf represents a frame period, τ represents a response time constant, and correction coefficient.

According to expression 19, the frame period Tf is constant, so correction operations can be performed by determining the response time constant τ and the correction coefficient alpha. This allows the circuit size and the number of parameters to be kept at a minimum.

Figure 41:
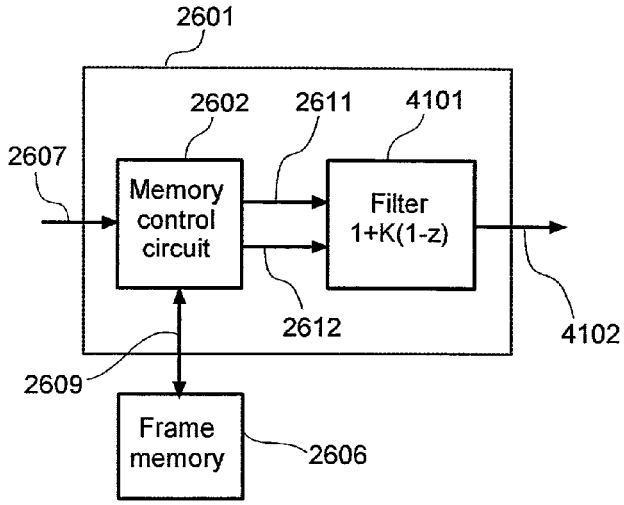
FIG. 41 is a block diagram showing the functional architecture of a data correction circuit according to an eleventh embodiment of the present invention.
Figure 42:
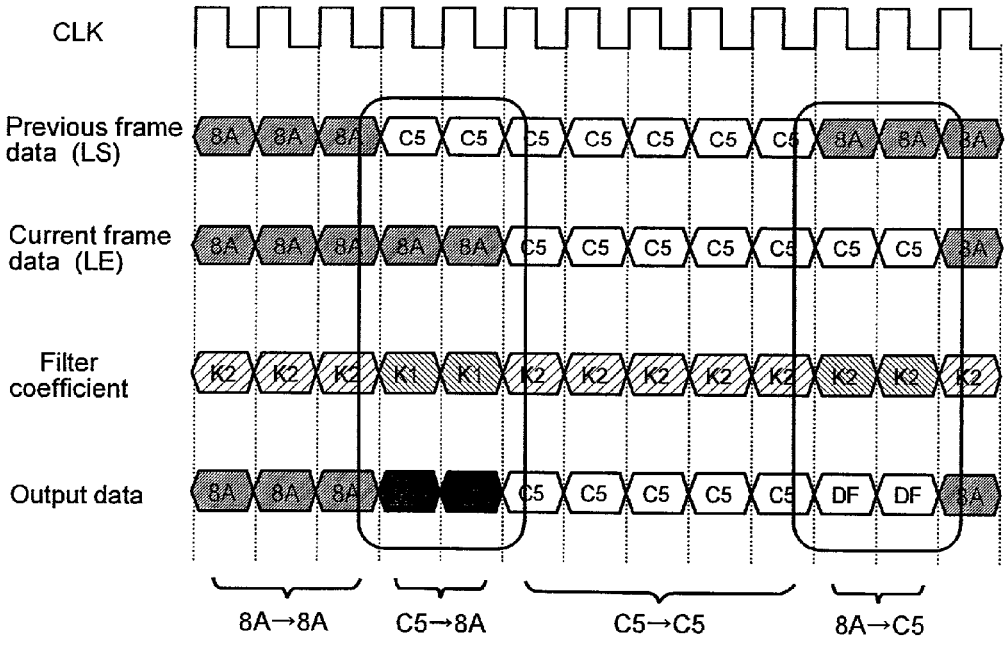
FIG. 42 is a timing chart of a correction operation in an eleventh embodiment of the present invention.

FIG. 41 is a functional block diagram of a data correction circuit implementing this filter. Blocks and signals in FIG. 41 that have already been described are designated by the same numerals. A filter circuit 4101 uses the transfer function indicated in expression 19 of this embodiment. The filter circuit 4101 receives the current frame data 2611 and the previous frame data 2612 as input and sends filtered data 4102 as output. The flow of operations is illustrated in the timing chart shown in FIG. 42. FIG. 42 shows an example where different filter coefficients are used for increasing change and decreasing change. A filter coefficient K1 is used for increasing changes, and a filter coefficient K2 is used for decreasing changes. For example, for a decrease from C5(HEX) to 8A(HEX), the filter coefficient K1 is used, resulting in an output of 64(HEX). For an increase from 8A(HEX) to C5(HEX), the filter coefficient K2 is used, resulting in an output of DF(HEX). Unchanged data is output directly with correction being performed only on changed sections, as in the previous embodiments. Using the filter circuit simplifies operations since no operations to access a table are needed. This allows the circuit to be simplified. Also, the filter can be implemented for liquid crystal panels having different characteristics simply by changing the filter coefficients.

FIG. 43 shows the optical response times in relation to gradation changes for liquid crystal modules 107 having different characteristics. FIG. 43A shows results of measuring optical response times in a normally black mode liquid crystal panel that uses a horizontal electric field. FIG. 43B is for a normally white mode liquid crystal panel that uses a vertical electric field. In both graphs, the horizontal axes show representative pre-change and post-change gradation data, and the vertical axis shows the luminance response time (0–90%) in milliseconds.

Since the two panels have significantly different response times, the same data table cannot be used for both when performing correction operations with a data table. Instead, separate data tables must be prepared for each panel. Of course, if the circuit is to be compatible with both panels the table data method can be used but the correction circuit will need to contain both tables. This leads to a significantly larger circuit. However, using the single-order digital filter of this embodiment will overcome this problem.

FIG. 44 shows an example of filter coefficients that can be used for the two panels. The response-time constant $\tau$ in FIG. 44 is calculated from average values of response times for all gradation data changes shown in FIG. 43. Different values of correction coefficient alpha are used for increases and decreases in gradation data. As a result, different filter coefficients are obtained for increases and decreases in horizontal electric field panels and vertical electrical field panels, as shown in FIG. 44.

Figure 45A:
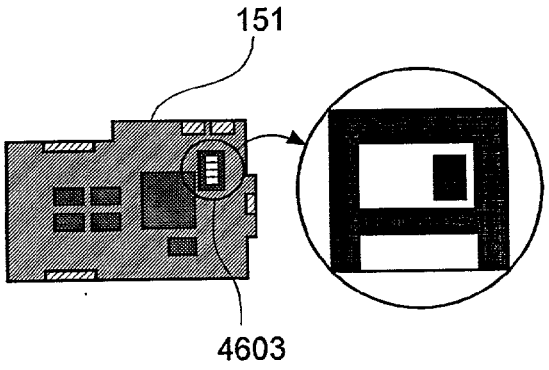
FIG. 45 is a figure showing a timing control substrate on which a filter coefficient settings switch is disposed in an eleventh embodiment of the present invention.
Figure 45B:
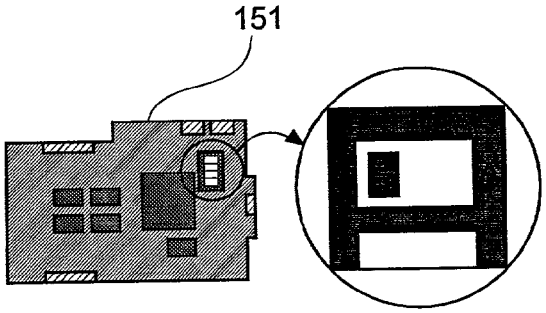
Figure 46:
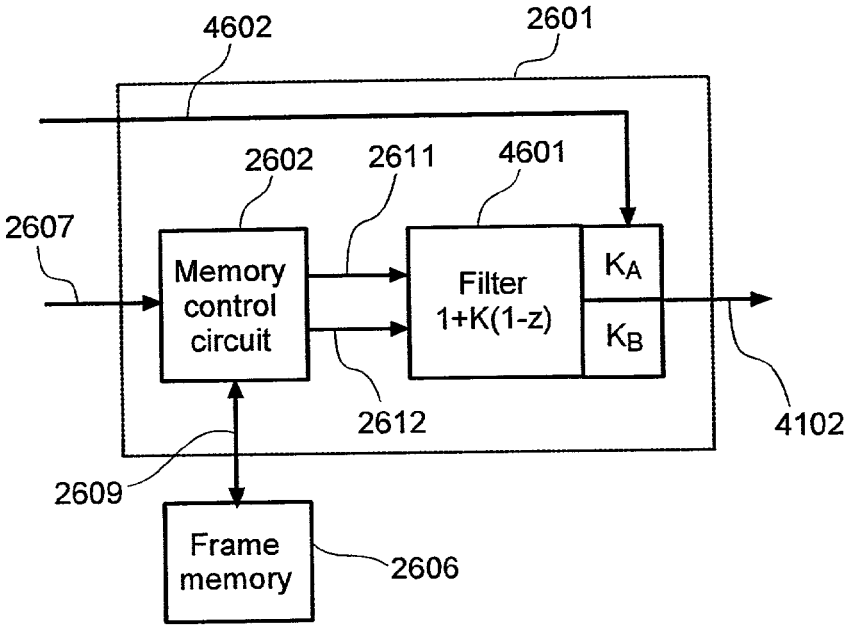
FIG. 46 is a block diagram showing the functional architecture of a correction circuit equipped with a filter coefficient setting feature in an eleventh embodiment of the present invention.

By providing a correction circuit compatible with liquid crystal characteristics that can be implemented with a small circuit and a small number of parameters, as in this embodiment, a video-compatible liquid crystal module can be easily created simply by selecting parameters based on the characteristics. An example is shown in FIG. 45. Liquid crystal panels A, B shown in FIG. 45 are, respectively, horizontal electric field and vertical electric field liquid crystal panels having the response characteristics shown in FIG. 43. When there are major differences in characteristics as in this case, timing control substrates equipped with filters having the same coefficients cannot be used for both types of panels. Instead, filter coefficients such as those shown in FIG. 44 can be calculated beforehand using the $\tau$ parameters and optical response characteristics from the specifications provided by liquid crystal panel manufacturers. These coefficients can be built into the correction circuit, and the selection switch shown in FIG. 45 can be used to appropriately switch the liquid crystal module in a quick and simple manner. FIG. 46 shows a block diagram of a data correction circuit with a selection feature. A mode signal 4602 is sent to the correction circuit shown in FIG. 41 to allow filter coefficients to be switched. A filter circuit 4601 switches the mode signal 4602 in response to a selection switch 4603 shown in FIG. 45. The coefficient KA is selected in the case of FIG. 45A, and the coefficient KB is selected in the case of FIG. 45B.

As described above, a single-order or higher order digital filter according to this embodiment allows the correction characteristics to be easily changed according to the characteristics of the liquid crystal panel 105 while keeping the circuit small. This improves the responsiveness of the liquid crystal module for video.

(Twelfth Embodiment)

This embodiment provides means for selecting correction levels including at least an option for no corrections. This allows correction to be controlled according to the preference of the user.

Figure 47:
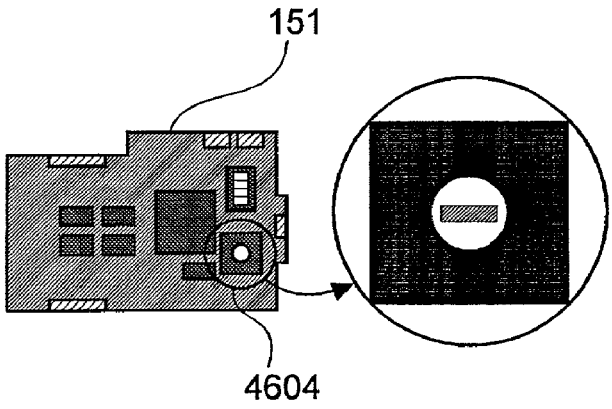
FIG. 47 is a figure showing a timing control substrate on which is disposed a filter coefficient adjustment switch in a twelfth embodiment of the present invention.

A summary of this embodiment will be described with reference to FIG. 47. FIG. 47 shows an example where a rotary switch 4604 is disposed on the timing control substrate so that a selection can be made from a number of correction levels. In this case, setting 0 on the rotary switch 4604 is the original setting where no correction is applied and setting 7 is a setting where complete correction is applied. Thus, there are six levels of correction from setting 1 to setting 6.

Figure 48:
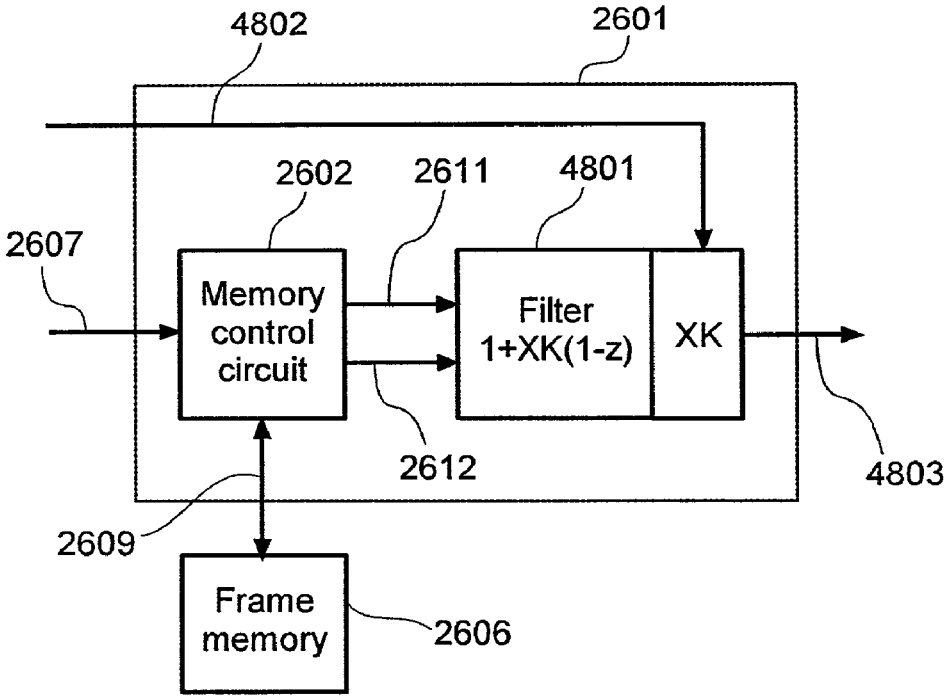
FIG. 48 is a block diagram showing the functional architecture of a correction circuit equipped with a filter coefficient adjustment feature in a twelfth embodiment of the present invention.

FIG. 48 shows a functional block diagram of a correction circuit implementing this feature. The signal from the rotary switch 4604 from FIG. 47 is transferred to a correction level adjustment signal 4802 in FIG. 48 and generates an output data 4804 from the filter circuit 4801, which multiplies a filter coefficient K by X ($0<=X<=1$). Thus, for example, if X=0 for setting 0 from FIG. 47, correction is not applied and the current frame data is output directly. If X=1 for setting 7, correction is fully applied for the display. If a setting from setting 1 through setting 6 on the rotary switch 4604 is used, correction can be controlled flexibly according to the user's preference or usage, e.g., a large coefficient can be used if video is viewed from a distance and a small coefficient can be used if video is viewed close up. FIG. 48 uses a filter circuit for the correction circuit, but it is also possible to use a previously described method such as interpolation using table data or approximation. Of course, these methods would involve a sacrifice in circuit size, processing speed, and the like.

What is claimed is:

1. A liquid crystal module for displaying video data, comprising:

a liquid crystal panel controlling a transparency of a liquid crystal interposed between image element electrodes and facing electrodes in response to a write voltage applied to said image element electrodes;

a timing control substrate equipped with a control circuit and a power supply circuit supplying power, said control circuit receiving and converting a video signal and a sync signal or a control signal, into a signal for said liquid crystal panel;

a scan substrate equipped with a scan driver circuit for supplying a selection voltage to said image element electrodes, via scan signal lines, based on a signal output from said timing control substrate; and a data substrate equipped with a data driver circuit for supplying said write voltage to said image element electrodes, via data signal lines;

wherein said timing control substrate further includes a correction circuit for receiving a gradation signal of video data, for generating a correction signal to increase luminance if a post-change gradation level of said gradation signal is greater than a pre-change gradation level of said gradation signal or for generating a correction signal to reduce luminance if said post-change gradation level of said gradation signal is less than said pre-change gradation level of said input gradation signal, and for correcting said post-change gradation signal using said correction signal;

wherein said correction circuit generates said correction signal to add a luminance that enables cancellation of a luminance deficit caused by a response delay in said liquid crystal panel if said gradation level of said post-change frame gradation signal is greater than said gradation level of said pre-change frame gradation signal;

wherein said correction circuit generates said correction signal to subtract luminance that enables cancellation of a luminance surplus caused by a response delay in said liquid crystal panel if said gradation level of said post-change frame gradation signal is less than said gradation level of said pre-change frame gradation signal;

wherein a target luminance which is represented on said liquid crystal panel based on said corrected post-change gradation signal overshoots a luminance to be represented on said liquid crystal panel based on a non-corrected said post-change gradation signal if said post-change gradation level of said gradation signal is greater than said pre-change gradation level of said gradation signal;

wherein said target luminance which is represented on said liquid crystal panel based on said corrected post-change gradation signal undershoots a luminance to be represented on said liquid crystal panel based on a non-corrected post-change gradation signal if said post-change gradation level of said gradation signal is less than said pre-change gradation level of said gradation signal;

wherein said correction circuit generates said correction signal based on a correction data table that pre-defines correction levels of said correction signal based on said gradation level of said post-change gradation signal and said gradation level of said pre-change gradation signal, and wherein said correction circuit generates correction levels of said correction signals not defined in said correction data table based on said correction signal correction levels predefined in said correction data table; and wherein, in said correction circuit, said correction level of said correction signal that is not pre-defined is a correction level contained in a range of +/−20% of a correction data DL obtained using $$DL = \begin{cases} if\,(TLE_{j+1} - TLE_j)(LS - TLS_i) + (TLS_{i+1} - TLS_i)(LE - TLE_{j+1}) \le 0: \\ TDL_{i,j} + \dfrac{TDL_{i+1,j} - TDL_{i,j}}{TLS_{i+1} - TLS_i}(LS - TLS_i) + \dfrac{TDL_{i,j+1} - TDL_{i,j}}{TLE_{j+1} - TLE_j}(LE - TLE_j) \\ \text{else} \\ TDL_{i+1,j+1} - \dfrac{TDL_{i+1,j+1} - TDL_{i,j+1}}{TLS_{i+1} - TLS_i}(TLS_{i+1} - LS) - \\ \dfrac{TDL_{i+1,j+1} - TDL_{i+1,j}}{TLE_{j+1} - TLE_j}(TLE_{j+1} - LE) \end{cases}$$

(where DL represents correction data, i represents a pre-change gradation table index, j represents a post-change gradation table index, TLS represents pre-change gradation table, TLE represents post-change gradation table, TDL represents correction table data, LS represents pre-change gradation data (TLSi<=LS<TLSi+1, and LE represents post-change gradation table (TLEi<=LE<TLEi+1).

2. A liquid crystal module according to claim 1, wherein said correction circuit includes a selection switch for selecting based on optical response characteristics or gradation signal optical characteristics of said liquid crystal.

3. A liquid crystal module according to claim 1, wherein said correction circuit includes a selection circuit for selecting a degree of correction.

4. A liquid crystal module according to claim 1, wherein said correction circuit generates a correction signal providing compensation so that a luminance deficit or surplus rate from said correction signal is in a range of −30% to 10% for intermediate gradations in three-frame intervals.

5. A liquid crystal module according to claim 1, wherein, said correction circuit includes an edge enhancement module enhancing edges of images displayed on said liquid crystal panel, said edge enhancement module receiving correction data from said data correction module and enhancing edges.

6. A liquid crystal module for displaying video data, comprising:

a liquid crystal panel controlling a transparency of a liquid crystal interposed between image element electrodes and facing electrodes in response to a write voltage applied to said image element electrodes;

a timing control substrate equipped with a control circuit and a power supply circuit supplying power, said control circuit receiving and converting a video signal and a sync signal or a control signal, into a signal for said liquid crystal panel;

a scan substrate equipped with a scan driver circuit for supplying a selection voltage to said image element electrodes, via scan signal lines, based on a signal output from said timing control substrate; and a data substrate equipped with a data driver circuit for supplying said write voltage to said image element electrodes, via data signal lines;

wherein said timing control substrate further includes a correction circuit for receiving a gradation signal of video data, for generating a correction signal to increase luminance if a post-change gradation level of said gradation signal is greater than a pre-change gradation level of said gradation signal or for generating a correction signal to reduce luminance if said post-change gradation level of said gradation signal is less than said pre-change gradation level of said input gradation signal, and for correcting said post-change gradation signal using said correction signal;

wherein said correction circuit generates said correction signal to add a luminance that enables cancellation of a luminance deficit caused by a response delay in said liquid crystal panel if said gradation level of said post-change frame gradation signal is greater than said gradation level of said pre-change frame gradation signal;

wherein said correction circuit generates said correction signal to subtract luminance that enables cancellation of a luminance surplus caused by a response delay in said liquid crystal panel if said gradation level of said post-change frame gradation signal is less than said gradation level of said pre-change frame gradation signal;

wherein a target luminance which is represented on said liquid crystal panel based on said corrected post-change gradation signal overshoots a luminance to be represented on said liquid crystal panel based on a non-corrected said post-change gradation signal if said post-change gradation level of said gradation signal is greater than said pre-change gradation level of said gradation signal;

wherein said target luminance which is represented on said liquid crystal panel based on said corrected post-change gradation signal undershoots a luminance to be represented on said liquid crystal panel based on a non-corrected post-change gradation signal if said post-change gradation level of said gradation signal is less than said pre-change gradation level of said gradation signal;

wherein said correction circuit generates said correction signal based on a slope data table pre-defining correction levels of said correction signal based on a slope in a change from said pre-change gradation signal gradation level to said post-change gradation signal gradation level and said pre-change gradation signal gradation level; and wherein, in said correction circuit, a parameter y representing the relation between said gradation levels and luminance is in a range of 1.8–2.2, a linear approximation with a bent-line graph is made of a relation between said slope of change and said correction level of said correction signal where a bend is positioned at an intermediate point between said pre-change gradation level of said gradation signal and a maximum gradation level if there is an increase in said gradation level, and, if there is a decrease in said gradation level, said correction signal correction level is a level contained in a range of +/−20% of a correction data DL obtained based on said slope data table and derived using $$DL = \begin{cases} \text{if } LE < LS : M1_i(LE - LS) \\ \text{else if } LS \le LE < \dfrac{LMAX + LS}{2} : M2_i(LE - LS) \\ \text{else if } LE \ge \dfrac{LMAX + LS}{2} : M2_i LMAX - \dfrac{LS}{2} - M3_i\left(LE - \dfrac{LMAX + LS}{2}\right) \end{cases}$$

(where DL represents correction data, i represents a line slope table index, M1 represents line slope table data (decreasing change), M2, M3 represents broken line slope table data (increasing change), LMAX represents maximum gradation data, LS represents pre-change gradation data, and LE represents post-change gradation data).

7. A liquid crystal module according to claim 6, wherein said correction circuit includes a selection switch for selecting based on optical response characteristics or gradation signal optical characteristics of said liquid crystal.

8. A liquid crystal module according to claim 6, wherein said correction circuit includes a selection circuit for selecting a degree of correction.

9. A liquid crystal module according to claim 6, wherein said correction circuit generates a correction signal providing compensation so that a luminance deficit or surplus rate from said correction signal is in a range of −30% to 10% for intermediate gradations in three-frame intervals.

10. A liquid crystal module according to claim 6, wherein, said correction circuit includes an edge enhancement module enhancing edges of images displayed on said liquid crystal panel, said edge enhancement module receiving correction data from said data correction module and enhancing edges.

11. A liquid crystal module for displaying video data, comprising:

a liquid crystal panel controlling a transparency of a liquid crystal interposed between image element electrodes and facing electrodes in response to a write voltage applied to said image element electrodes;

a timing control substrate equipped with a control circuit and a power supply circuit supplying power, said control circuit receiving and converting a video signal and a sync signal or a control signal, into a signal for said liquid crystal panel;

a scan substrate equipped with a scan driver circuit for supplying a selection voltage to said image element electrodes, via scan signal lines, based on a signal output from said timing control substrate; and a data substrate equipped with a data driver circuit for supplying said write voltage to said image element electrodes, via data signal lines;

wherein said timing control substrate further includes a correction circuit for receiving a gradation signal of video data, for generating a correction signal to increase luminance if a post-change gradation level of said gradation signal is greater than a pre-change gradation level of said gradation signal or for generating a correction signal to reduce luminance if said post-change gradation level of said gradation signal is less than said pre-change gradation level of said input gradation signal, and for correcting said post-change gradation signal using said correction signal;

wherein said correction circuit generates said correction signal to add a luminance that enables cancellation of a luminance deficit caused by a response delay in said liquid crystal panel if said gradation level of said post-change frame gradation signal is greater than said gradation level of said pre-change frame gradation signal;

wherein said correction circuit generates said correction signal to subtract luminance that enables cancellation of a luminance surplus caused by a response delay in said liquid crystal panel if said gradation level of said post-change frame gradation signal is less than said gradation level of said pre-change frame gradation signal;

wherein a target luminance which is represented on said liquid crystal panel based on said corrected post-change gradation signal overshoots a luminance to be represented on said liquid crystal panel based on a non-corrected said post-change gradation signal if said post-change gradation level of said gradation signal is greater than said pre-change gradation level of said gradation signal;

wherein said target luminance which is represented on said liquid crystal panel based on said corrected post-change gradation signal undershoots a luminance to be represented on said liquid crystal panel based on a non-corrected post-change gradation signal if said post-change gradation level of said gradation signal is less than said pre-change gradation level of said gradation signal;

wherein said correction circuit generates said correction signal based on a slope data table pre-defining correction levels of said correction signal based on a slope in a change from said pre-change gradation signal gradation level to said post-change gradation signal gradation level and said pre-change gradation signal gradation level; and wherein, in said correction circuit, a parameter y representing the relation between said gradation levels and luminance is in a range of 1.8–2.2, a quadratic approximation is made of a relation between said slope of change and said correction level of said correction signal where a center line is positioned at an intermediate point between said pre-change gradation level of said gradation signal and a maximum gradation level if there is an increase in said gradation level, and, if there is a decrease in said gradation level, said correction signal correction level is a level contained in a range of +/−20% of a correction data DL obtained derived using $$DL = \begin{cases} \text{if } LE < LS : A1_i(LE^2 - LS^2) \\ \text{else if } LS \le LE : -A2_i\left\{\left(LE - \dfrac{LS + LMAX}{2}\right)^2 - \left(\dfrac{LS - LMAX}{2}\right)^2\right\} \end{cases}$$

(where DL represents correction data, i represents a quadratic coefficient table index, A1 represents quadratic coefficient table data (decreasing change), A2 represents quadratic coefficient table data (increasing change), LMAX represents maximum gradation data, LS represents pre-change gradation data, and LE represents post-change gradation data) and based on a quadratic coefficient data table determined by said pre-change gradation level and obtained by approximating a relation between said slope of change and said correction signal correction level with a quadratic function having a center line at a line at a minimum gradation level.

12. A liquid crystal module according to claim 11, wherein said correction circuit includes a selection switch for selecting based on optical response characteristics or gradation signal optical characteristics of said liquid crystal.

13. A liquid crystal module according to claim 11, wherein said correction circuit includes a selection circuit for selecting a degree of correction.

14. A liquid crystal module according to claim 11, wherein said correction circuit generates a correction signal providing compensation so that a luminance deficit or surplus rate from said correction signal is in a range of −30% to 10% for intermediate gradations in three-frame intervals.

15. A liquid crystal module according to claim 11, wherein, said correction circuit includes an edge enhancement module enhancing edges of images displayed on said liquid crystal panel, said edge enhancement module receiving correction data from said data correction module and enhancing edges.

16. A liquid crystal module for displaying video data, comprising:

a liquid crystal panel controlling a transparency of a liquid crystal interposed between image element electrodes and facing electrodes in response to a write voltage applied to said image element electrodes;

a timing control substrate equipped with a control circuit and a power supply circuit supplying power, said control circuit receiving and converting a video signal and a sync signal or a control signal, into a signal for said liquid crystal panel;

a scan substrate equipped with a scan driver circuit for supplying a selection voltage to said image element electrodes, via scan signal lines, based on a signal output from said timing control substrate; and a data substrate equipped with a data driver circuit for supplying said write voltage to said image element electrodes, via data signal lines;

wherein said timing control substrate further includes a correction circuit for receiving a gradation signal of video data, for generating a correction signal to increase luminance if a post-change gradation level of said gradation signal is greater than a pre-change gradation level of said gradation signal or for generating a correction signal to reduce luminance if said post-change gradation level of said gradation signal is less than said pre-change gradation level of said input gradation signal, and for correcting said post-change gradation signal using said correction signal;

wherein said correction circuit generates said correction signal to add a luminance that enables cancellation of a luminance deficit caused by a response delay in said liquid crystal panel if said gradation level of said post-change frame gradation signal is greater than said gradation level of said pre-change frame gradation signal;

wherein said correction circuit generates said correction signal to subtract luminance that enables cancellation of a luminance surplus caused by a response delay in said liquid crystal panel if said gradation level of said post-change frame gradation signal is less than said gradation level of said pre-change frame gradation signal;

wherein a target luminance which is represented on said liquid crystal panel based on said corrected post-change gradation signal overshoots a luminance to be represented on said liquid crystal panel based on a non-corrected said post-change gradation signal if said post-change gradation level of said gradation signal is greater than said pre-change gradation level of said gradation signal;

wherein said target luminance which is represented on said liquid crystal panel based on said corrected post-change gradation signal undershoots a luminance to be represented on said liquid crystal panel based on a non-corrected post-change gradation signal if said post-change gradation level of said gradation signal is less than said pre-change gradation level of said gradation signal; and wherein, in said correction circuit, said correction signal correction level is a level contained in a range of +/−20% of a correction data DL obtained based on a filter coefficient and a transfer function of a finite impulse filter and derived using $$K = \frac{\alpha\tau}{T_f}$$

(where H(z) represents a transfer function, K represents a filter coefficient, Tf represents one frame interval, τ represents a response-time constant, and alpha represents a correction coefficient).

17. A liquid crystal module according to claim 16, wherein said correction circuit includes a selection switch for selecting based on optical response characteristics or gradation signal optical characteristics of said liquid crystal.

18. A liquid crystal module according to claim 16, wherein said correction circuit includes a selection circuit for selecting a degree of correction.

19. A liquid crystal module according to claim 16, wherein said correction circuit generates a correction signal providing compensation so that a luminance deficit or surplus rate from said correction signal is in a range of −30% to 10% for intermediate gradations in three-frame intervals.

20. A liquid crystal module according to claim 16, wherein, said correction circuit includes an edge enhancement module enhancing edges of images displayed on said liquid crystal panel, said edge enhancement module receiving correction data from said data correction module and enhancing edges.

* * * * *